US008732906B1

(12) United States Patent
Van Gennep

(10) Patent No.: US 8,732,906 B1
(45) Date of Patent: May 27, 2014

(54) LOCKING HINGE ASSEMBLY

(71) Applicant: Jan Van Gennep, Lakeport, CA (US)

(72) Inventor: Jan Van Gennep, Lakeport, CA (US)

( * ) Notice: Subject to any disclaimer, the term of this patent is extended or adjusted under 35 U.S.C. 154(b) by 0 days.

(21) Appl. No.: 13/839,905

(22) Filed: Mar. 15, 2013

Related U.S. Application Data

(63) Continuation-in-part of application No. 12/985,573, filed on Jan. 6, 2011, now Pat. No. 8,656,558, which is a continuation-in-part of application No. 12/708,397, filed on Feb. 18, 2010, now Pat. No. 8,359,709.

(60) Provisional application No. 61/316,963, filed on Mar. 24, 2010, provisional application No. 61/641,260, filed on May 1, 2012, provisional application No. 61/153,585, filed on Feb. 18, 2009.

(51) Int. Cl.
*E05D 11/10* (2006.01)

(52) U.S. Cl.
USPC ..... 16/229; 16/328; 16/353; 16/262; 16/386

(58) Field of Classification Search
USPC ..... 16/265, 260, 261, 262, 263, 270, 254, 16/255, 256, 257, 258, 259, 319, 321, 328, 16/329, 331, 352, 353, 324, 381, 386, 229, 16/327, 323, 326, 332, 349, 378, 380, 230, 16/231, 232
See application file for complete search history.

(56) References Cited

U.S. PATENT DOCUMENTS

| | | | | | |
|---|---|---|---|---|---|
| 2,542,340 | A * | 2/1951 | Mauraton | ..... | 16/381 |
| 3,448,486 | A | 6/1969 | Wright | | |
| 3,629,900 | A * | 12/1971 | Beerli, Jr. | ..... | 16/349 |
| 3,744,085 | A * | 7/1973 | Griego | ..... | 16/325 |
| 3,924,293 | A * | 12/1975 | Cain | ..... | 16/380 |
| 3,977,044 | A * | 8/1976 | Mort | ..... | 16/380 |
| 4,528,718 | A | 7/1985 | Brockhaus | | |
| 4,675,940 | A * | 6/1987 | Brockhaus | ..... | 16/273 |
| 4,854,009 | A * | 8/1989 | Brockhaus | ..... | 16/263 |
| 4,864,688 | A * | 9/1989 | Gerber | ..... | 16/261 |
| 4,991,259 | A * | 2/1991 | Finkelstein et al. | ..... | 16/312 |
| 5,577,295 | A * | 11/1996 | Papke et al. | ..... | 16/254 |
| 5,706,556 | A * | 1/1998 | Kluting | ..... | 16/273 |
| 5,820,288 | A | 10/1998 | Cole | | |
| 5,881,150 | A * | 3/1999 | Persson | ..... | 379/433.13 |
| 6,091,938 | A * | 7/2000 | Go | ..... | 455/575.3 |
| 6,205,616 | B1 * | 3/2001 | Hwang | ..... | 16/229 |
| 6,292,980 | B1 * | 9/2001 | Yi et al. | ..... | 16/303 |
| 6,859,978 | B2 * | 3/2005 | Pan | ..... | 16/292 |
| 6,922,872 | B2 * | 8/2005 | Gruber | ..... | 16/260 |
| 7,228,596 | B2 * | 6/2007 | Kang | ..... | 16/330 |
| 7,325,276 | B2 * | 2/2008 | Kim | ..... | 16/262 |
| 7,603,746 | B1 * | 10/2009 | von Resch et al. | ..... | 16/245 |
| 8,156,611 | B2 * | 4/2012 | Machin et al. | ..... | 16/261 |
| 2004/0025294 | A1 * | 2/2004 | Gruber | ..... | 16/254 |
| 2009/0056075 | A1 * | 3/2009 | Green et al. | ..... | 16/328 |

* cited by examiner

*Primary Examiner* — Jeffrey O Brien
(74) *Attorney, Agent, or Firm* — Craig M. Stainbrook; Stainbrook & Stainbrook, LLP

(57) ABSTRACT

A locking hinge including barrel members with a cylindrical female recess and a multi-sided center bore. A medial barrel member has a center bore and first and second cylindrical male portions rotatably inserted into one of the female recesses, and a multi-sided center bore, such that the bores are in axial alignment. First and second hinge pins have a cylindrical portion and a multi-sided portion slidably inserted through the aligned multi-sided center bores. A spring disposed in the medial barrel member urges the hinge pins apart. When in a fully locked configuration, the multi-sided portions of the hinge pins engage the multi-sided center bore of a male portion and a barrel member; when in an unlocked configuration, at least one or both of the hinge pins is depressed such that its multi-sided portion is disengaged from the multi-sided center bore of the barrel member through which it is slidably inserted.

2 Claims, 36 Drawing Sheets

LOCKING HINGE ASSEMBLY

CROSS REFERENCES TO RELATED APPLICATIONS

The present application is a continuation-in-part of U.S. patent application Ser. No. 12/985,573, filed Jan. 6, 2011 (Jan. 6, 2011); which is a continuation-in-part of U.S. patent application Ser. No. 12/708,397 (now issued U.S. Pat. No. 8,359,709), filed Feb. 18, 2010 (Feb. 18, 2010), which claims the benefit of U.S. Provisional Patent Application Ser. No. 61/153,585 filed Feb. 18, 2009 (Feb. 18, 2009); and further claims the benefit of U.S. Provisional Patent Application Ser. No. 61/316,963, filed Mar. 24, 2010 (Mar. 24, 2010); and still further claims the benefit of U.S. Provisional Patent Application Ser. No. 61/641,260, filed May 1, 2012 (May 1, 2012).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

SEQUENCE LISTING

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to hinge assemblies, and more particularly to hinges for closures, such as doors, windows, hatches, lids, ports, and the like, and also for panels or surface members that pivot in relation to another panel or surface member, such as shelves, awnings, ramps, gates, and the like.

2. Discussion of Related Art including information disclosed under 37 CFR §§1.97, 1.98

Locking hinges and hinge assemblies are known. Exemplary publications teaching such technology include:

U.S. Pat. No. 5,820,288 to Cole, which teaches an adjustable tool with a locking hinge mechanism. The tool may be moved between a number of selectable positions through the use of a hinge pin, which is splined along its length and holds the portions of the tool together. The hinge pin is movable between an unlocked position and a locked position. In the unlocked position, the tool is adjustable, and in the locked position the tool is fixed in position and ready for use.

U.S. Pat. No. 4,528,718 to Brockhaus shows a door hinge including a first and a second hinge member each having eyes with a hinge pin inserted through the eyes of the hinge members to connect them operatively together. The hinge pin is mounted so as to be freely rotatable relative to a first eye but secured against axial movement relative thereto. The hinge pin and a second eye are formed with axially extending splines engaged between them, and adjacent the splines also axially disposed is the hinge pin, which is formed with a cylindrical section that engages within a complementary cylindrical recess in the second eye, the cylindrical section having a diameter which is slightly greater than the addendum circle diameter of the splines.

U.S. Pat. No. 3,448,486 to Wright, teaches a locking hinge with a sliding adjustable pintle for locking cabinets, doors, lids, and the like. The pintle is formed with splines and is adjustable to a locked and unlocked position. In the locked position the splines engage hinge knuckles such that the hinge is prevented from turning. In the open position, the splines are disengaged from the knuckles and the hinge is free to turn.

The foregoing prior art reflects the current state of the art of which the present inventor is aware. Reference to, and discussion of, this prior art is intended to aid in discharging Applicant's acknowledged duty of candor in disclosing information that may be relevant to the examination of claims to the present invention. However, it is respectfully submitted that none of the above-indicated publications disclose, teach, suggest, show, or otherwise render obvious, either singly or when considered in combination, the invention described and claimed herein.

BRIEF SUMMARY OF THE INVENTION

The present invention is a novel hinge assembly that includes a first hinge member having a leaf and a lower sleeve. The lower sleeve includes an upper cylindrical passage with a first diameter and a lower cylindrical passage axially disposed immediately under the upper cylindrical passage and having a second diameter smaller than that of the upper cylindrical passage. The lower cylindrical passage has an interior wall with either a geometrical shape or surface topography. A second hinge member includes a leaf portion and an upper sleeve, the upper sleeve including an upper female portion and a lower male element extending axially downwardly from the female portion and has an outer diameter sized to fit tightly into the opening of the upper cylindrical passage of the lower sleeve so as to provide a smooth pivotal connection between the first and second hinge members. The male element further includes a lower portion with an interior wall configured substantially identically to that of the interior wall of the lower cylindrical passage of the lower sleeve. A through hole passes through the upper sleeve elements. When the male element of the upper sleeve is inserted into the lower sleeve, the through hole is axially aligned with the upper cylindrical passage and the lower cylindrical passage of the lower sleeve. A hinge pin is inserted into the upper cylindrical passage of the second hinge member and the lower cylindrical passage of the first hinge member. The hinge pin includes an outer surface configured or contoured in such a way to cooperate with the configuration of the interior wall of the lower sleeve. The hinge pin has an elevated unlocked position and a depressed locked position, such that when in the unlocked position no portion of the hinge pin outer surface engages the interior walls to prevent pivotal rotation of the hinge members in relation to one another, and when pushed into the down and locked position, the outer surface of the hinge pin engages the interior walls to prevent the hinge members from rotating in relation to one another.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and its objects and advantages will become apparent when consideration is given to the following detailed description thereof. Such description makes reference to the annexed drawings wherein.

DETAILED DESCRIPTION OF THE INVENTION

Figure 2:
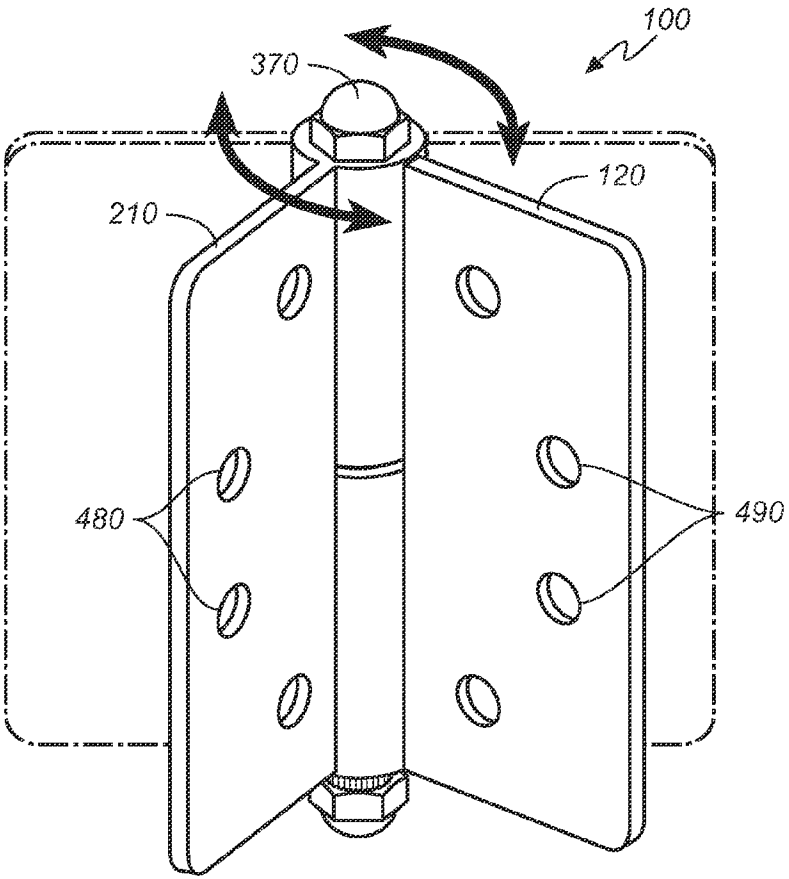
FIG. 2 is an upper front perspective view showing the possible hinge leaves rotation about the hinge pin when in an unlocked position so as to assume a partly closed position.
Figure 1:
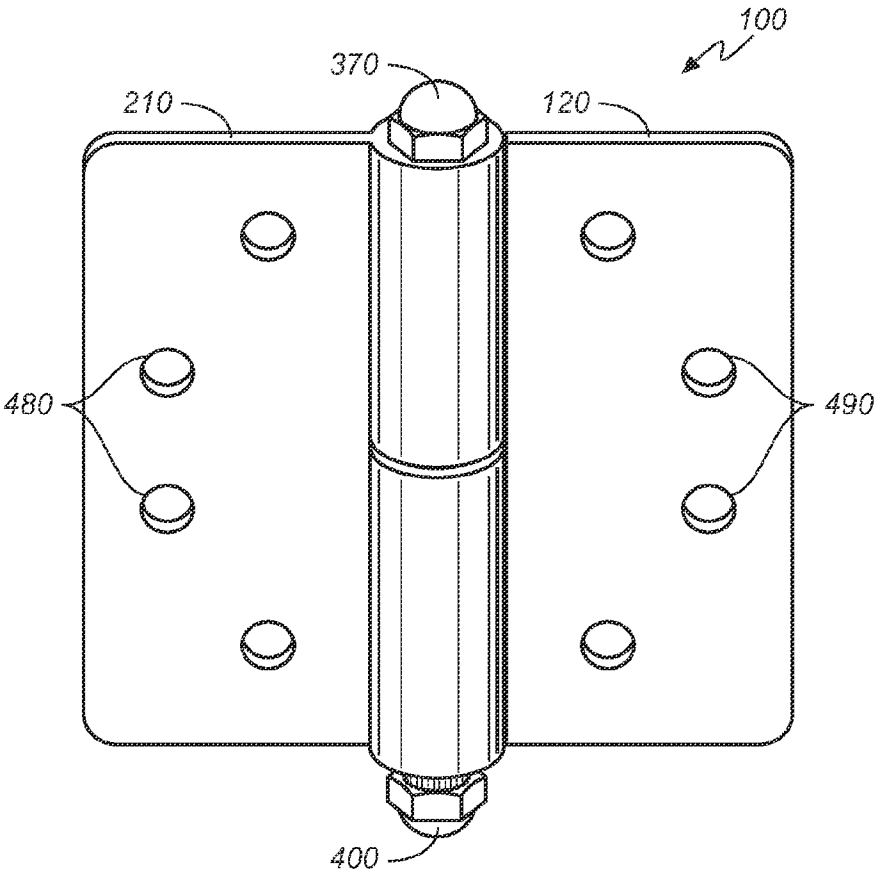
FIG. 1 is an upper front perspective view showing the inventive hinge assembly in a fully open and unlocked position.
Figure 1A:
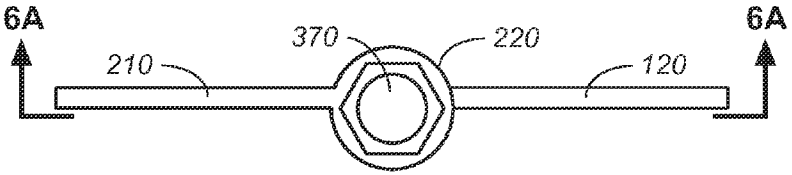
FIG. 1A is a top plan view thereof.
Figure 2A:
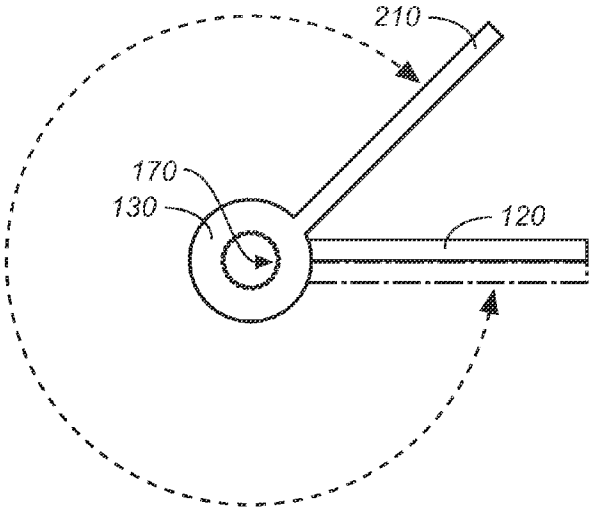
FIG. 2A is a top plan view thereof.
Figure 3:
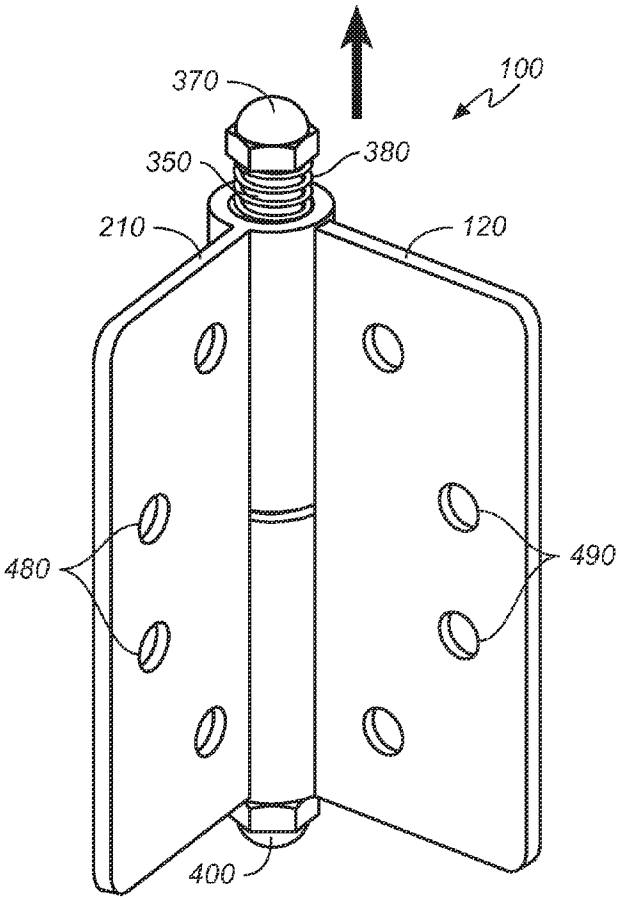
FIG. 3 shows the hinge assembly in a partly closed position and the hinge pin pushed into a locked position to prohibit all hinge leaf rotation.
Figure 4:
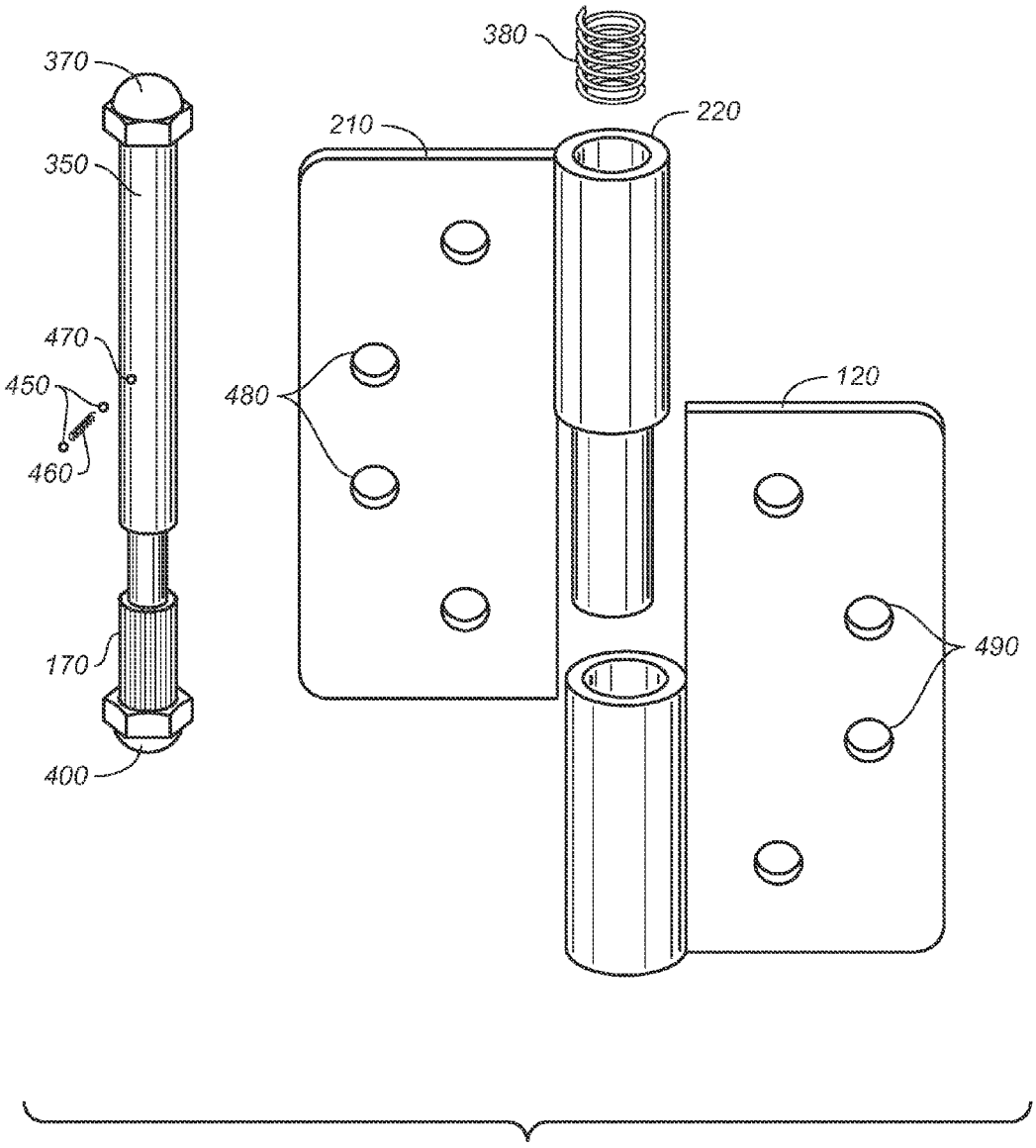
FIG. 4 is an exploded upper front perspective view of the hinge of FIGS. 1-3.
Figure 5:
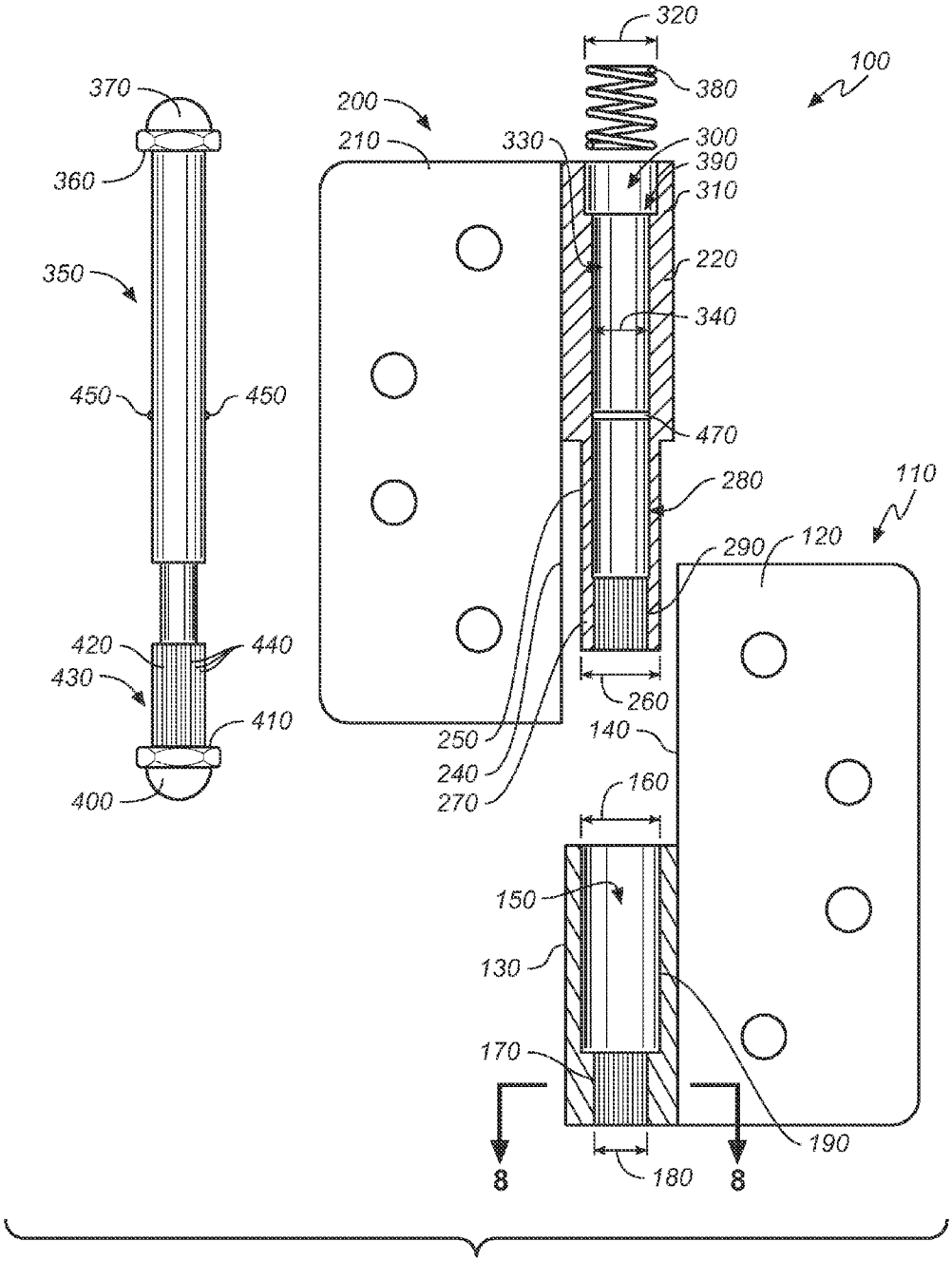
FIG. 5 is an exploded front view in elevation showing the upper and lower hinge sleeves in cross section.
Figure 6B:
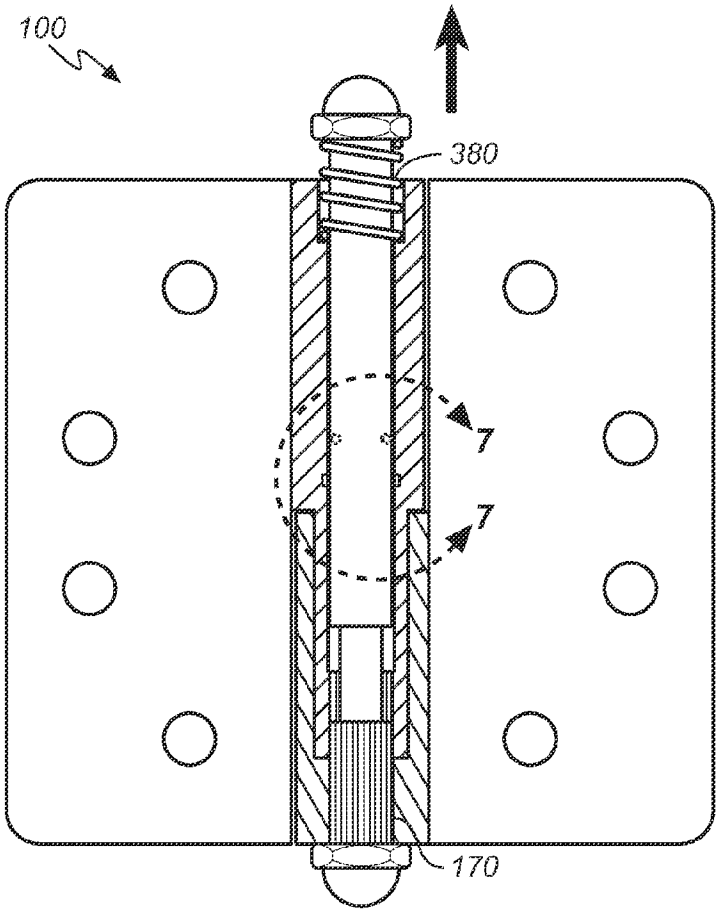
FIG. 6B is a partial cross-sectional front view in elevation showing the hinge in an unlocked position.
Figure 6A:
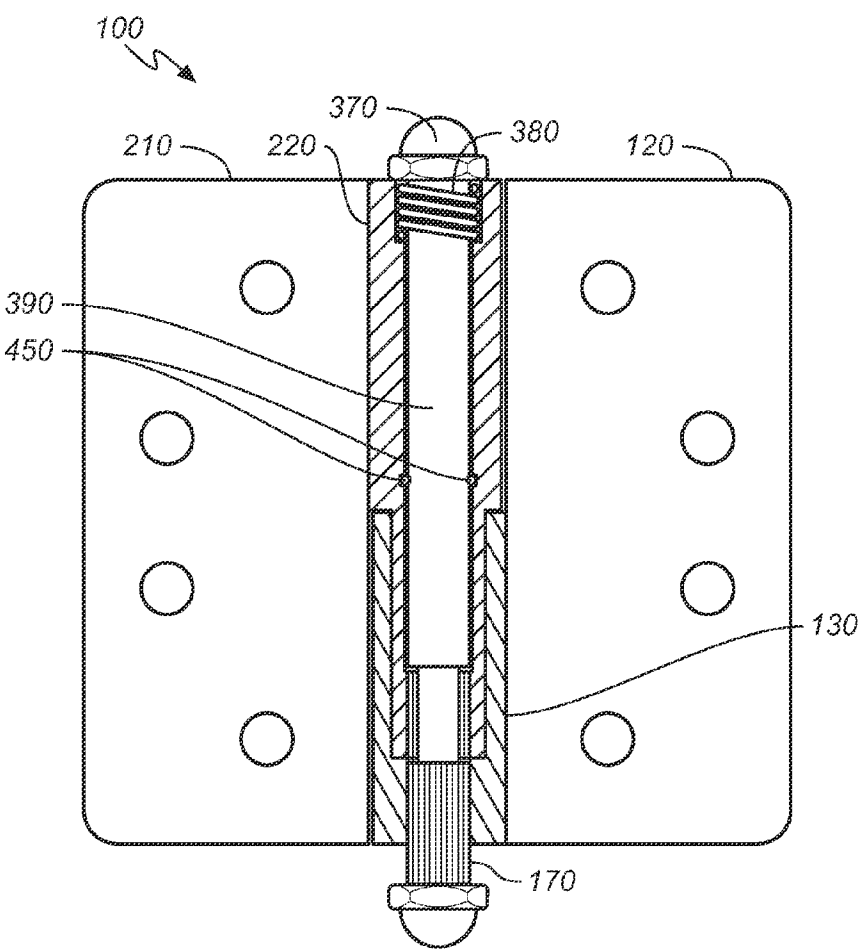
FIG. 6A is a partial cross-sectional front view in elevation taken along section lines 6A-6A of FIG. 1 showing the hinge in a locked position.
Figure 7:
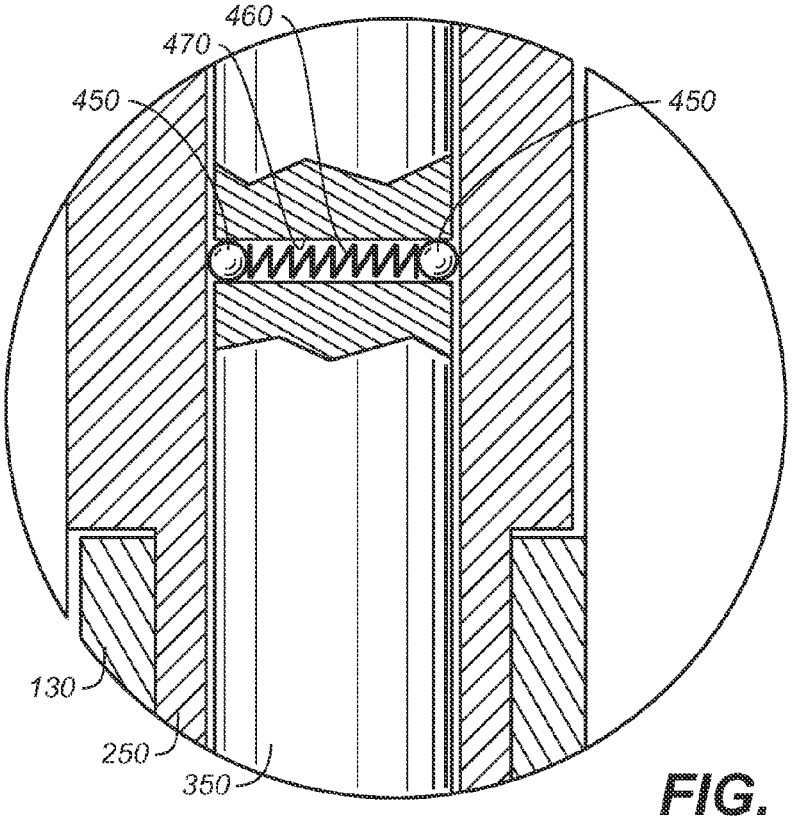
FIG. 7 is a detailed view taken along section line 7-7 of FIG. 6B, showing the spring loaded ball bearing detent used to prevent unwanted migration of the hinge pintle from either the unlocked or locked position.
Figure 8:
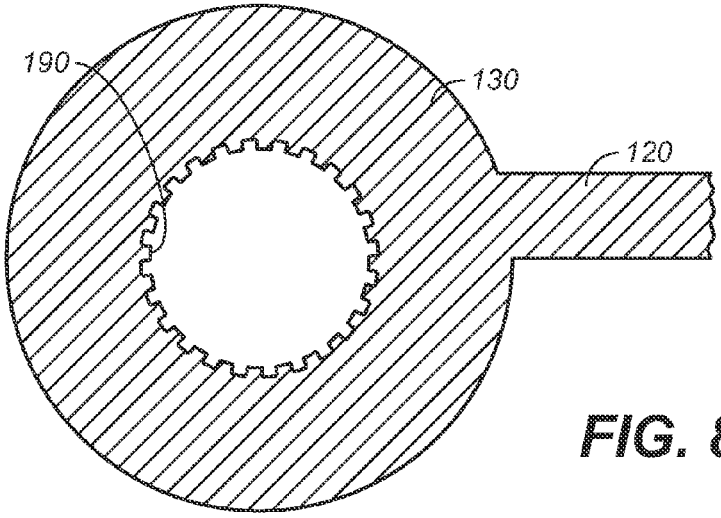
FIG. 8 is an upper cross-sectional view showing the splined interior of the lower hinge leaf taken along section line 8-8 of FIG. 5.
Figure 9A:
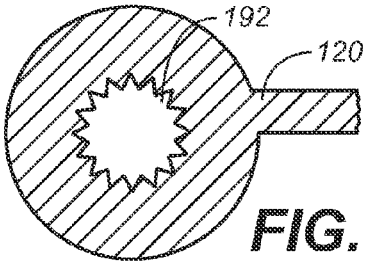
FIG. 9A shows an alternative configuration or shape for the exterior of the locking element of the hinge sleeve.
Figure 9B:
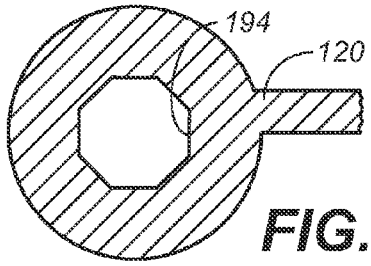
FIG. 9B shows yet another alternative configuration for the locking element of the hinge sleeve.

Referring first to FIGS. 1 through 12, wherein like reference numerals refer to like components in the various views, there is illustrated the new and improved locking hinge assembly of the present invention, generally denominated 100 herein. These views collectively show that in a preferred embodiment, the inventive hinge assembly includes a first hinge member 110 having a leaf portion 120 and a lower cylindrical sleeve portion (a gudgeon or eye) 130, which is roughly half the height of the leaf portion in dimension and extends along and is integral with the lower half of the interior edge 140 of the leaf portion. The lower sleeve 130 has an upper cylindrical passage 150 with a first diameter 160 and a lower cylindrical passage 170 axially disposed immediately under the upper cylindrical passage 150 and having a second diameter 180 smaller than that of the upper cylindrical passage. The lower cylindrical passage has an interior wall 190 that is splined (FIG. 8) or otherwise provided with a surface topography, e.g., gear teeth 192 (FIG. 9A) or with a cross-sectional shape 194 (FIG. 9B) so as to function as a locking element in cooperation with the hinge pin (described fully below).

The hinge assembly next includes a second hinge member 200 having a leaf portion 210 and an upper sleeve (eye or gudgeon) 220, the upper sleeve including an upper female portion 230 also comprising roughly half the height of the leaf portion and integral with the upper half of the inner edge 240 of the leaf portion. The upper sleeve further includes a lower male element 250 extending axially downwardly from the female portion and having an outer diameter 260 sized for a tight fit insertion into the opening of the upper cylindrical passage 150 of the lower sleeve 130 in a manner well known in the art so as to provide a smooth pivotal connection between the two hinge members. A lower portion 270 of the male element interior wall 280 is splined 290 or otherwise configured or shaped identically to that of the interior wall 190 of the lower cylindrical passage 170 of the lower sleeve 130.

The upper sleeve includes a recess 300 (or countersink) at its upper end 310 and having a first diameter 320 and a cylindrical through hole 330 having a second diameter 340. When the male element of the upper sleeve is inserted into the lower sleeve 130, the through hole 330 is axially aligned with the upper cylindrical passage 150 and the lower cylindrical passage 170 of the lower sleeve 130 so as to accommodate insertion of a hinge pin 350. The hinge pin includes an upper end 360 capped by an upper nut 370 threadably installed on the hinge pin. A helical compression spring 380 is disposed between the underside of the upper nut and the base 390 of the recess 300 in the upper sleeve. A lower nut 400 is threadably installed on the lower end 410 of the hinge pin. The helical compression spring is optional and is needed only when a single leaf hinge is employed, such as in a gate installation. While the spring may be employed to assist in keeping the hinge pin in an elevated (unlocked) position, the detent mechanism described below is sufficient for most applications.

Next, the outer surface 420 of a lower portion 430 of the hinge pin includes splines, gear teeth, or a shape or geometric cross-sectional configuration 440 that cooperates with the splined interior wall 190 of the lower sleeve 130 to prevent rotation of the hinge pin. It will be seen that when the hinge is pushed up into the unlocked position, no portion of the hinge pin splines engages the splines (or other topography or shape) to prevent pivotal rotation of the hinge.

The hinge pin further includes at least one, and preferably two, detent mechanisms, comprising first and second ball and spring combinations 450, 460, disposed in a through hole 470 drilled through the pin. A single spring may be employed with balls disposed at each end, and the balls are thus biased against the opposing sides of the interior portion of the female portion of the upper sleeve as the hinge pin travels through the upper sleeve. It will be seen that when the hinge pin is pushed down into the unlocked position (FIG. 6A) ball and spring combinations disposed in the through hole of the hinge pin cooperates with female portion of the upper sleeve prevent excursion of the hinge upwardly. When the hinge pin is pushed upwardly and out of the locked configuration (FIG. 6B), the helical compression spring 380 (if provided) and the ball and spring combinations 450, 460 work to prevent unwanted drop of the hinge pin back into the locked position. When in the locked position, the splines on the hinge pin engage both the interior wall 190 of the lower cylindrical passage 170 of the lower sleeve 130 and the splines of the male element interior wall 290 such that the hinge members are prevented from pivoting relative to one another.

In the illustrated exemplary embodiment, the hinge members are shown as conventional butt/mortise door hinges, each having a plurality of holes 480, 490, for securing the hinge member to a door and/or door frame, though countless other hinge styles and configurations may incorporate the inventive system disclosed herein.

Figure 12:
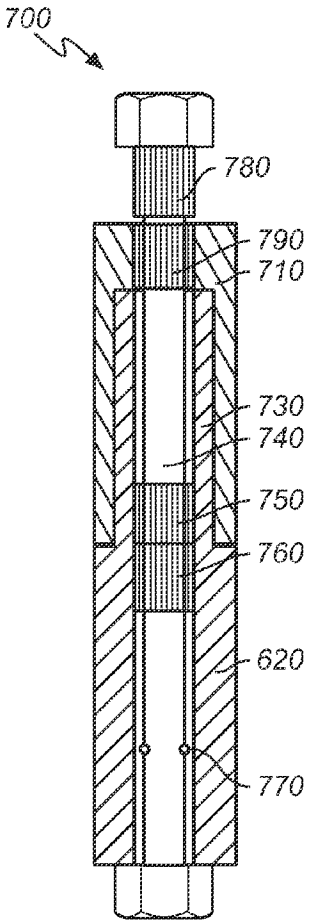
FIG. 12 is a cross-sectional side view in elevation showing the upper and lower sleeve portions and hinge pint of a fourth preferred embodiment.
Figure 11:
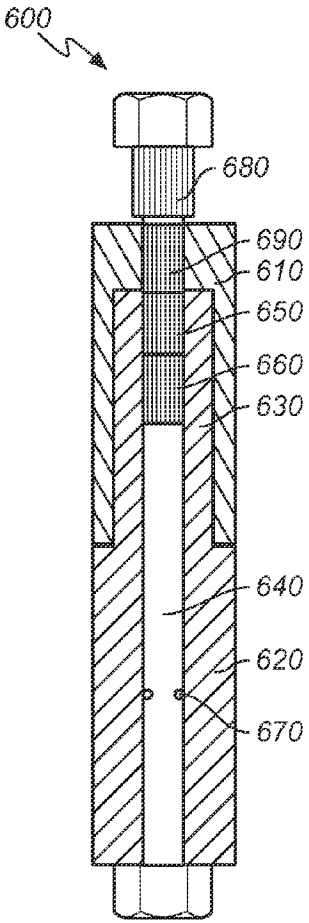
FIG. 11 is a cross-sectional side view in elevation showing the upper and lower sleeve portions and hinge pint of a third preferred embodiment.
Figure 10:
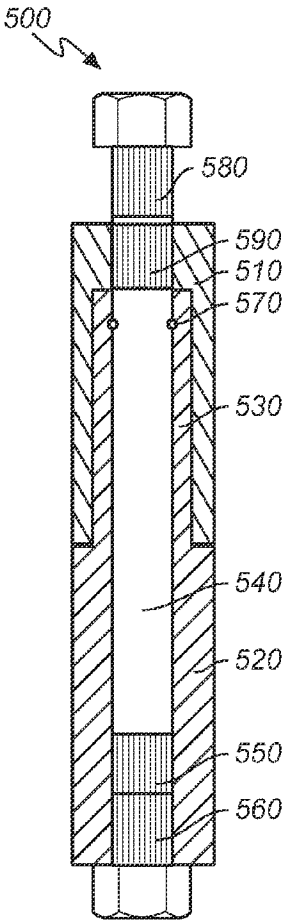
FIG. 10 is a cross-sectional side view in elevation showing the upper and lower sleeve portions and hinge pin of a second preferred embodiment of the inventive locking hinge.
Figure 13B:
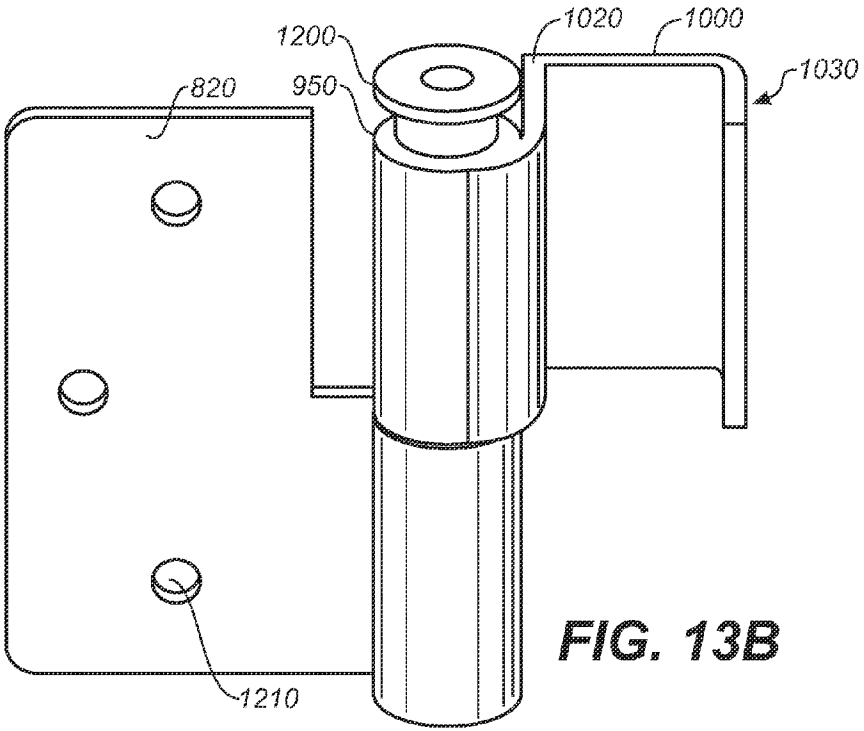
FIG. 13B is an upper front perspective showing the hinge in the locked position.
Figure 14:
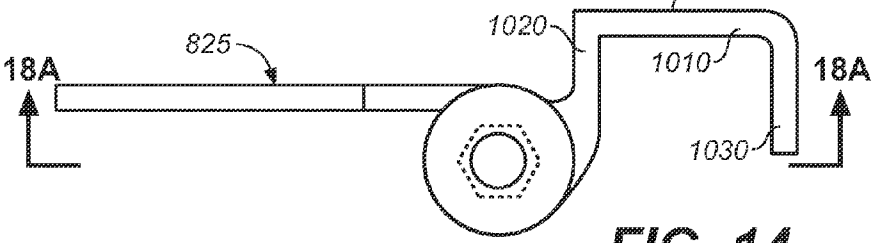
FIG. 14 is a top plan view thereof.
Figure 13A:
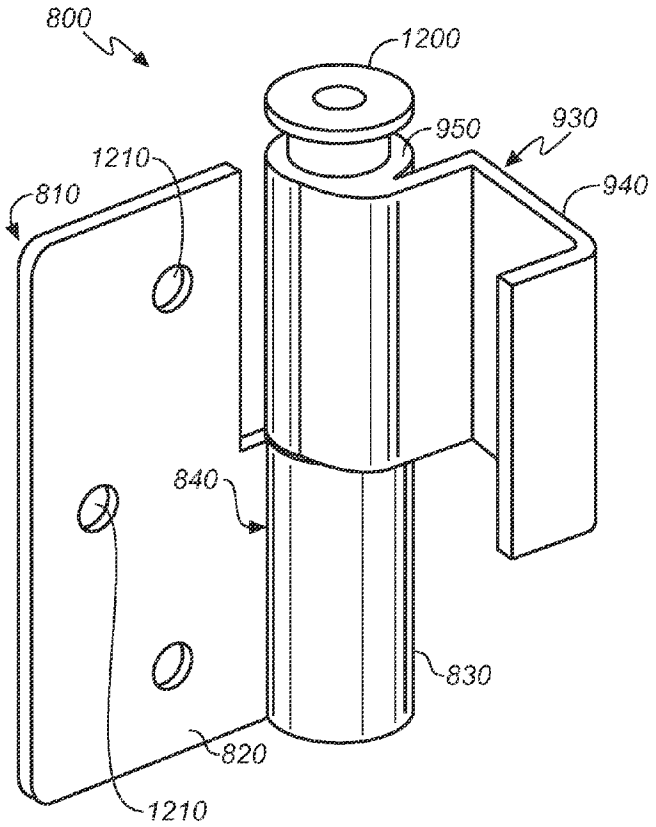
FIG. 13A is an upper front left perspective view of a fifth preferred embodiment of the present invention showing the hinge in the unlocked position.

Referring next to FIGS. 10-12, there is shown a second, a third, and a fourth preferred embodiments, respectively, 500, 600, 700, of the novel locking hinge assembly, each providing a slightly different structural relationship of the operative elements of the invention. It will be appreciated that the changes relate principally to the relocation of the cooperative splined elements and the detent mechanism either upwardly or downwardly from the positions shown in the first preferred embodiment. In all other material respects, the inventive apparatus is essentially functionally identical to the above-described first preferred embodiment.

In each of the second, third, and fourth preferred embodiments, the apparatus includes an upper sleeve portion 510, 610, 710, a lower sleeve portion 520, 620, 720, having a male element 530, 630, 730, and a hinge pin 540, 640, 740 with splines 550, 650, 750, disposed around its exterior circumference that engage splines 560, 660, 760 disposed on the interior wall of some portion of the lower sleeve when the pin is in the locked position (shown in all three views). The spring detents 570, 670, 770 prevent the pin from moving from its locked position. When pushed into the unlocked position, splines 580, 680, 780, at one end of the hinge pin engage splines 590, 690, 790 disposed in the upper sleeve portion.

FIGS. 13A through 18B show yet another embodiment of the inventive hinge assembly. In this fifth preferred embodiment 800, there is included a first hinge member 810 having a generally planar hinge leaf portion 820 and a lower cylindrical sleeve portion 830, roughly half the height of the leaf portion in dimension and extends along and is integral with the lower half of an interior edge 840 of the leaf portion. The lower sleeve 830 has an upper cylindrical passage 850 with a first diameter 860 and a lower cylindrical passage 870 axially disposed immediately under the upper cylindrical passage 850 and having a second diameter 880 greater than that of the upper cylindrical passage. The upper cylindrical passage has an interior wall 890 having a geometry or otherwise provided with a surface topography, e.g., splines, gear teeth, etc., or with a cross-sectional shape so as to function as a locking element in cooperation with the hinge pin. The lower sleeve includes an upper male element 900 extending axially upwardly from a lower female portion 910 and having an outer diameter 920 sized for a tight fit insertion into the opening of the lower cylindrical passage of the lower sleeve portion of the second hinge member (described below). The fit gives rise to a smooth pivotal connection between the two hinge members.

The hinge assembly next includes a second hinge member 930 having a latch leaf portion 940 and an upper sleeve 950, the upper sleeve including a cylindrical upper female portion 960, a medial portion 970 and a lower female portion 980. The upper and lower female portions each have an interior diameter corresponding to the outer diameter of the male element of the lower sleeve. The medial portion has an interior wall 990 corresponding in shape and size with the interior wall 890 of the lower sleeve.

The latch leaf portion 940 of the second hinge member 930, unlike that of the leaf portion of the first hinge member, is U-shaped, not planar, with bends turning in a clockwise direction as viewed from above. In the locked position (FIGS. 13B, 14) the back side 1000 of the medial plate 1010 of leaf portion 940 is generally parallel with the back side 825 of the hinge leaf portion 820 of the first hinge member. The connecting segment 1020 is integral with the upper sleeve 950 and is oriented substantially normal relative to the medial plate. The distal segment 1030 is integral with the medial plate and is preferably generally parallel with the connecting segment, thus also substantially normal relative to the medial plate.

As will be appreciated from the foregoing, when the male element 900 of the lower sleeve 830 is inserted into the lower female portion 980 of the upper sleeve 950, the holes in the upper and lower sleeves become axially aligned and form a continuous bore into which a hinge pin 1040 may be inserted. The hinge pin includes a threaded upper end 1050, a cylindrical middle portion 1060, and a contoured lower portion 1070, the latter having an outside shape that conforms to the interior wall of the medial portion 970 of the upper sleeve and the interior wall 890 of the upper male element 900. The contoured lower portion 1070 is sized for very tight clearances from the interior walls of the medial portion and male element portion. The hinge pin further includes a round head sized for tight clearances from the interior diameter 880 of the lower female portion 910 of sleeve 830. This allows the hinge pin to slide freely within the lower female portion.

A helical compression spring 1090 is disposed in the upper female portion 960 of the upper sleeve, and when the hinge pin is inserted through the aligned lower and upper sleeves, it is threadably capped with a hinge pin cap 1200.

Figure 17:
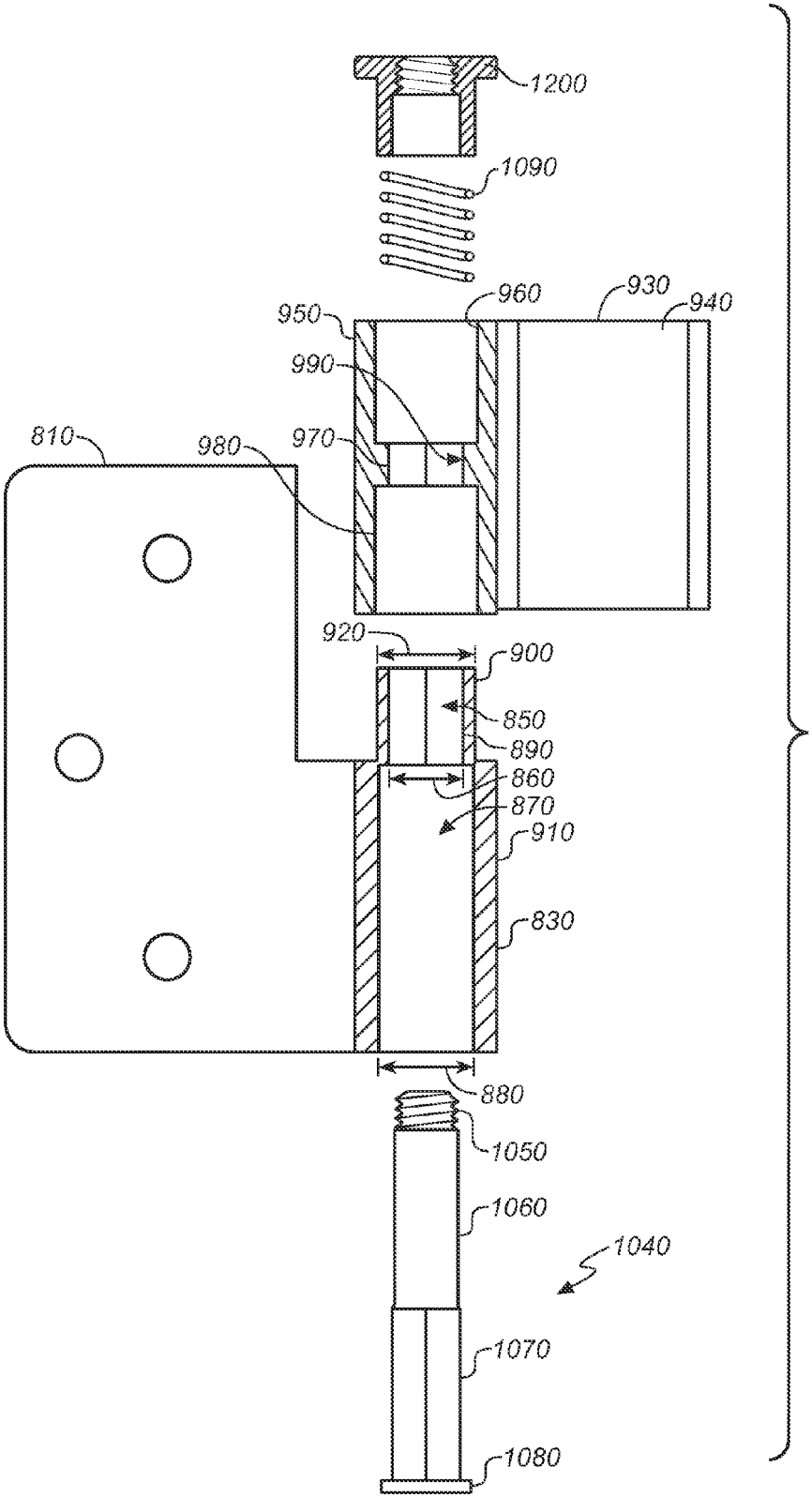
FIG. 17 is an exploded front cross-sectional view in elevation taken along section lines 18A-18A of FIG. 14.
Figure 18B:
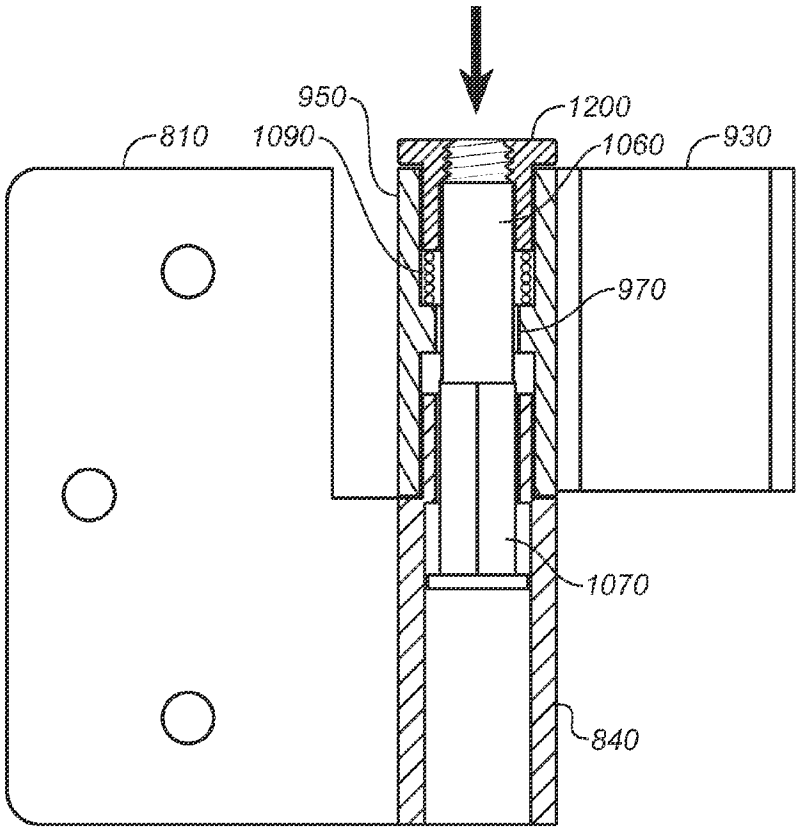
FIG. 18B is a front cross-sectional view showing the hinge in the unlocked position.
Figure 18A:
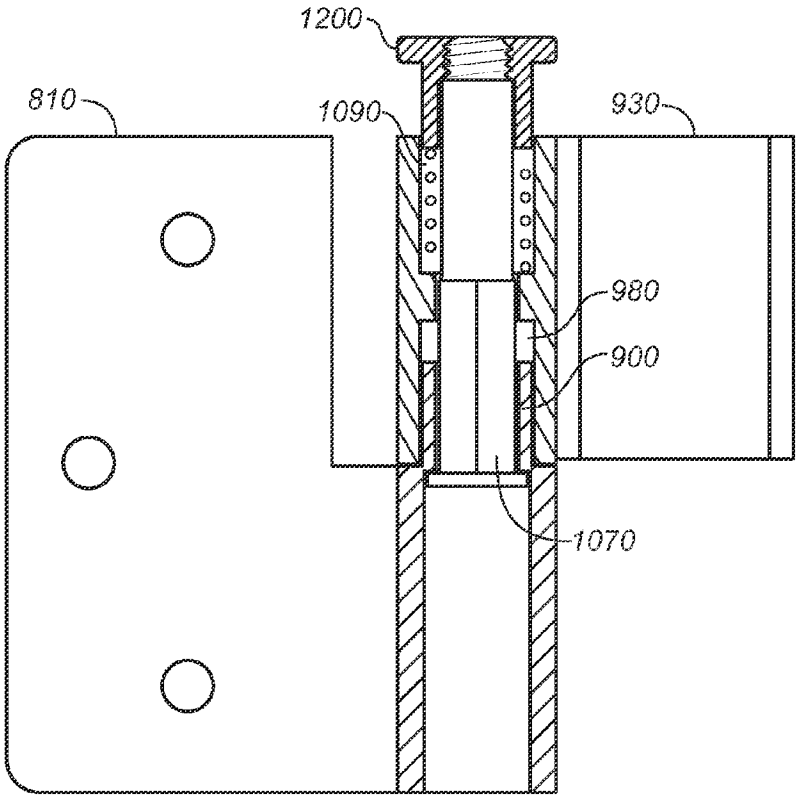
FIG. 18A is a front cross-sectional view showing the hinge in the locked position.
Figure 19B:
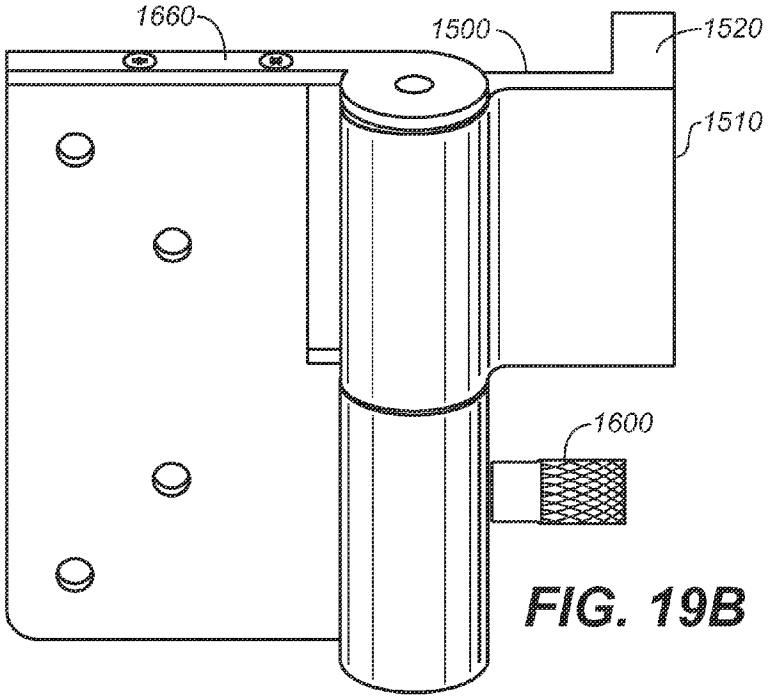
FIG. 19B is an upper front perspective showing the hinge in the locked position.
Figure 20:
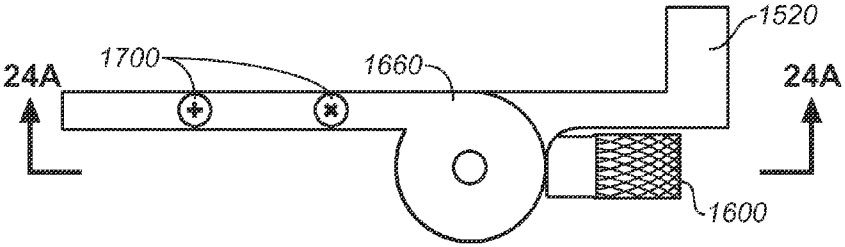
FIG. 20 is a top plan view thereof.
Figure 19A:
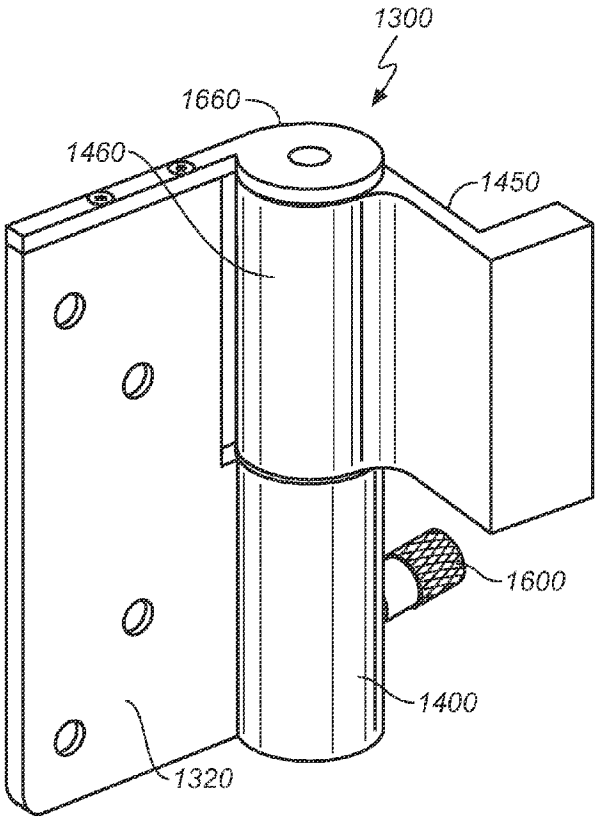
FIG. 19A is an upper front left perspective view of a sixth preferred embodiment of the present invention showing the hinge in the unlocked position.

As can be seen best by referring to FIGS. 17 and 18A-18B, the hinge pin has a length such that the most elevated position for the pin brings the base of the head into contact with the shoulder defined by the changing diameters between the lower and upper female portions of the lower sleeve. As seen in FIG. 18A, the helical compression spring urges the hinge pin upward into that most elevated position, and in so doing brings the lower portion 1070 of the hinge pin into full engagement with the interior wall 890 of the male element 900 of the lower sleeve, and the interior wall 990 of medial portion 970 of the upper sleeve.

As shown in FIG. 18B, when the hinge pin cap is pushed down, the hinge pin lower portion is pushed out from both the interior wall 890 of the male element 900 and the interior wall 990 of medial portion 970. At this time, the hinge is unlocked and the first and second hinge members can pivot freely in relation to one another. When the desired orientation of the leaf portions is achieved, the pin is simply released and allowed to elevate, thereby pulling the hinge pin back into the locked position.

Figure 15:
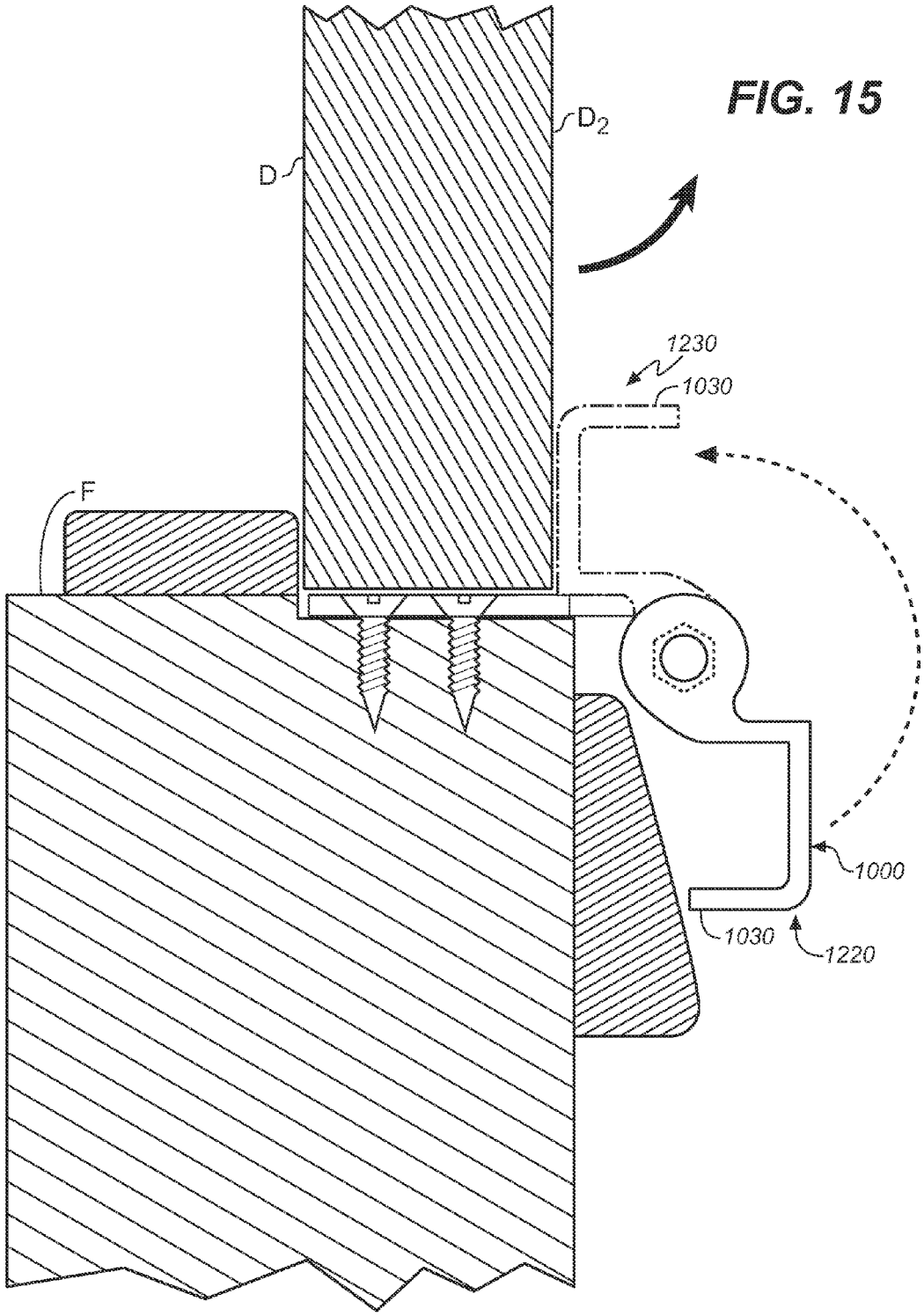
FIG. 15 is a cross-sectional top plan view showing the fifth preferred embodiment installed on a door frame and illustrating the pivot range of the latch leaf from the unlocked to the locked position.
Figure 16:
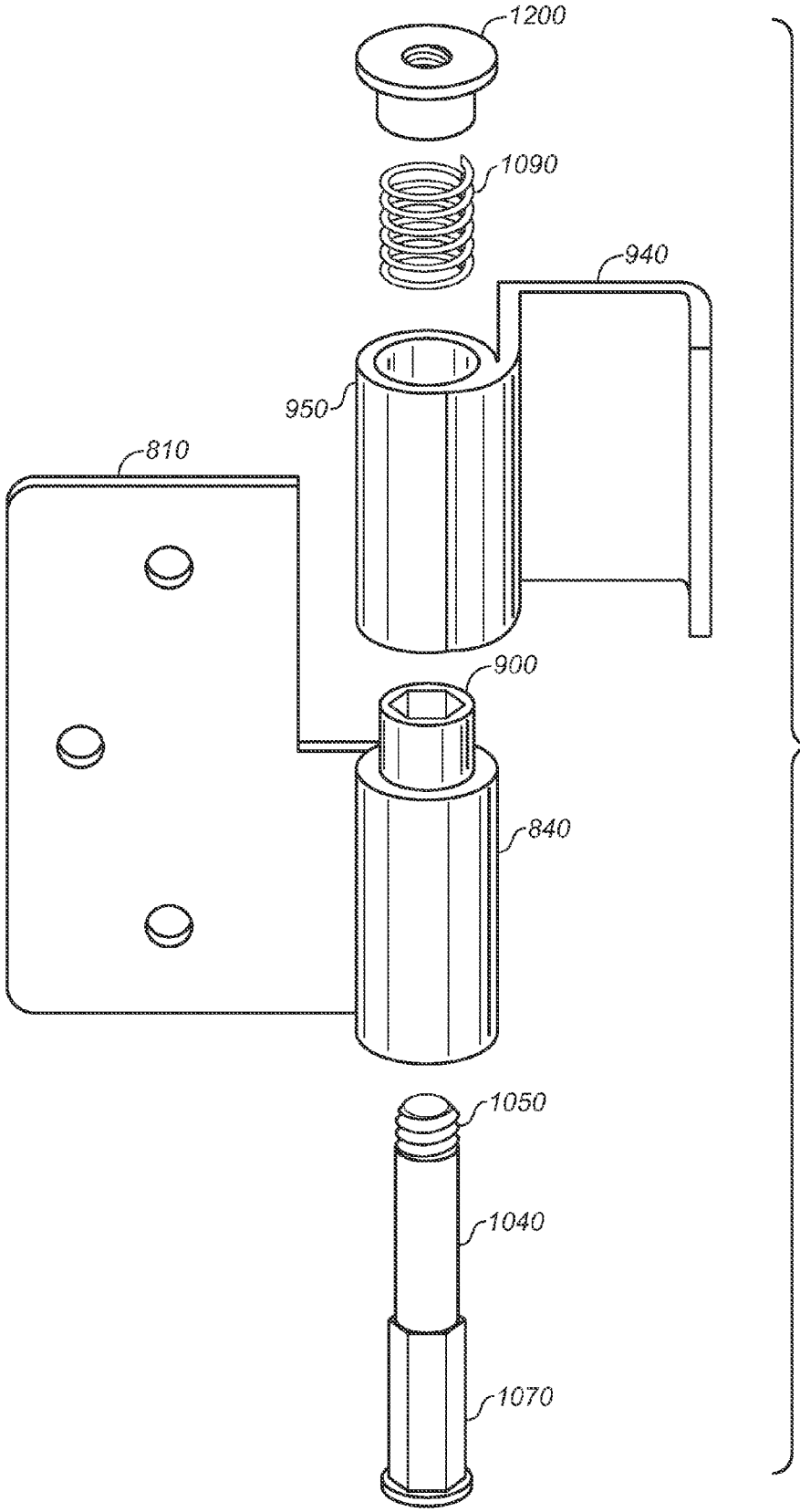
FIG. 16 is an exploded upper front perspective view of the fifth preferred embodiment.

As shown in FIG. 15, this embodiment of the present invention is recess mounted on the door frame F on the handle side of the door D. The screw holes 1210 in the hinge leaf portion allow screws to be passed and countersunk for a flush surface. The latch leaf portion is then free to pivot a full 180 degrees from a full unlocked position 1220 to a fully locked position 1230, which brings the back side 1000 of the hinge leaf portion into engagement with the interior side D2 of the door. In this position, the contoured sides of the lower portion of the hinge pin are brought into alignment with the configured interior wall of the medial portion of the upper sleeve and interior wall of the male element of the lower sleeve, as described above. The action required by the user to free the hinge latch for pivotal movement amounts to nothing more than depressing the hinge pin at its cap. To return the locking hinge to its unlocked position, the user again need only depress the hinge pin. As long as the pin is fully depressed, the latch will pivot freely. As soon as it is released, the latch will "catch" and lock wherever the configured portions are fully approximated.

In this way, the locking hinge of the present invention gives a home owner either supplemental or replacement door lock protection. A door can be either temporarily or permanently locked using the inventive hinge. If an emergency were to arise necessitating the rapid unlocking of the door to allow ingress of persons from outside or egress of persons from inside the structure, the lock can be opened quite quickly with the simple press of a button (i.e., the hinge pin cap). Conversely, if the door were unlocked and an occupant felt the need to lock it urgently, it can be swung into the locked position in one swift move.

In relation to known conventional door hinges, a significant distinguishing feature of the inventive locking hinge resides in the effect of removing the hinge pin. In the case of the prior art, the hinges essentially separate when the hinge pin is removed, much to the consternation of any handyman who has tried to remove or hang a door. By contrast, the inventive locking hinge includes a male element that slips into a female element so as to prevent such a separation. Indeed, the combined hinge members provide a fully functional hinge even without the hinge pin installed. The hinge pin provides further stability, but its essential function is not to hold the hinge members together, but to provide a rapid locking/unlocking mechanism.

In an alternative expression 1300, shown in FIGS. 19A-24B, the locking hinge of the present invention can employ a pull, rather than push, mechanism as a lock release.

FIGS. 19A through 24B show yet another embodiment of the inventive hinge assembly. This sixth preferred embodiment 1300 includes a first hinge member 1310 having a generally planar hinge leaf portion 1320 and a lower cylindrical sleeve portion 1330 integral with and extending along a lower portion of an interior edge 1340 of the hinge leaf portion. The lower sleeve 1330 has an upper passage 1350 that is square or rectangular in cross section and a lower passage 1360 disposed immediately under the upper passage. The lower passage may be cylindrical or configured with an alternative cross-sectional shape. In any event, it is sized so as to provide free clearance of the interior wall 1370 of the lower passage as the hinge leaf portion rotates about the hinge pin, as described below. The upper cylindrical passage has an interior wall 1380 having a geometry or otherwise provided with a surface topography, e.g., splines, gear teeth, etc., or with a cross-sectional shape so as to function as a locking element in cooperation with the hinge pin. The lower sleeve 1330 includes an upper male element 1390 extending axially upwardly from a lower female portion 1400 and having an outer diameter 1410 sized for a tight fit pivotal insertion into the lower cylindrical passage 1420 of the lower sleeve portion 1430 of the second hinge member 1440.

As with all previous embodiments, the sixth preferred embodiment next includes a second hinge member 1440 having a latch leaf portion 1450 and an upper sleeve 1460, the upper sleeve including an upper female portion 1470, a choked down medial portion 1480 and a lower female portion 1420. The upper female portion may be cylindrical or have an alternative cross sectional shape. However, the lower female portion is cylindrical and has an interior diameter slightly larger than the outer diameter of the male element of the lower sleeve. The medial portion 1480 has an interior wall 1490 corresponding in shape and size with the locking surface of the hinge pin (described below).

The latch leaf portion 1450 of the second hinge member 1440 is L-shaped, with a stem 1500 integral with the upper sleeve 1460 and a single outboard bend or turn 1510 directed in a counterclockwise direction as viewed from above (see, e.g., FIG. 20) to form a door-engaging leg 1520.

Figure 23:
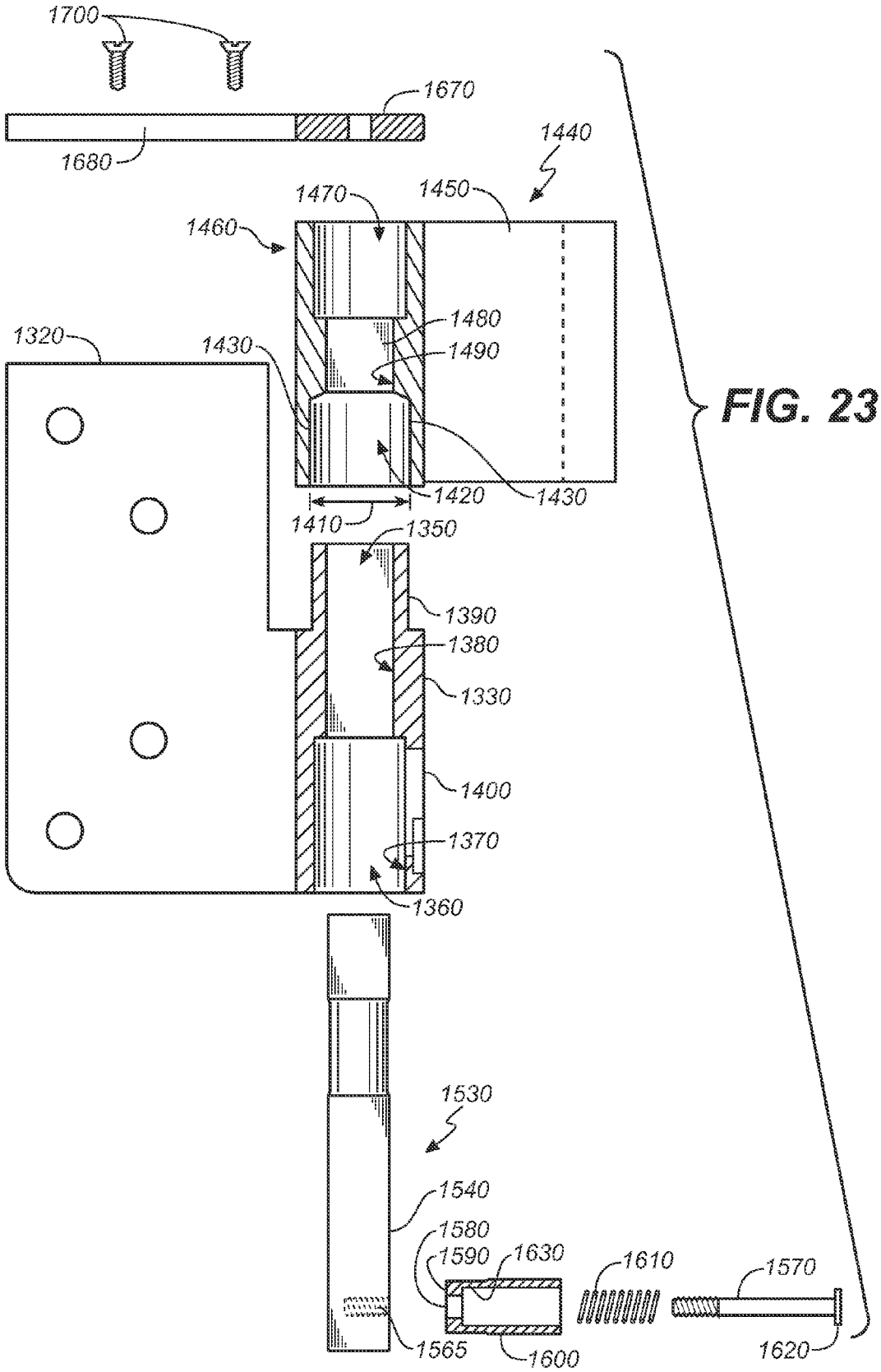
FIG. 23 is an exploded front cross-sectional view in elevation taken along section lines 24A-24A of FIG. 20.

The hinge pin employed in this embodiment departs from the design employed in the earlier embodiments. Rather than having a generally cylindrical cross-sectional shape, the pin has a generally square or rectangular cross-sectional shape, and only a portion of the hinge pin is cylindrical. Shapes other than square or rectangular may be employed for the purpose of defining the possible number of stop or lock positions available to the user when opening and closing the latch (which may be better appreciated by referring to FIGS. 21A-21B). Referring for the moment to FIG. 23, it is seen that the hinge pin 1530 comprises a head 1540 having a square or rectangular cross-sectional shape, an upper medial cylindrical neck 1550, and a lower portion 1560 preferably, though not necessarily, having a cross-sectional shape or surface topography conforming to that of head 1540. At its lower end, hinge pin 1530 includes a threaded hole 1565 that receives the thread end of a lock pin 1570 inserted through a hole 1580 in the base 1590 of a knob 1690. A spring 1610 is axially disposed around the shaft of lock pin 1570, interposed between the head 1620 of the lock pin and the inboard side 1630 of the knob.

Figure 24B:
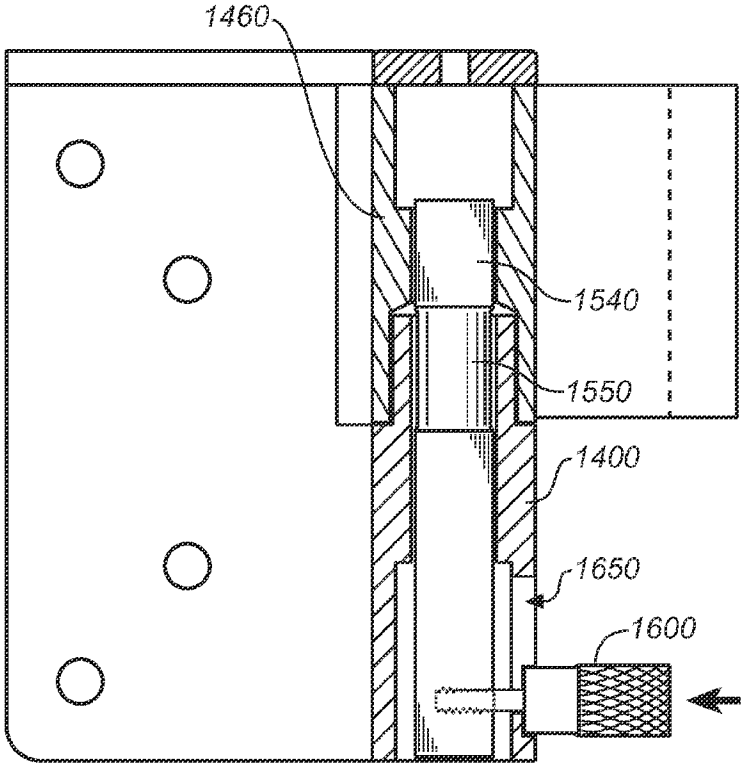
FIG. 24B is a front cross-sectional view showing the hinge in the locked position.
Figure 24A:
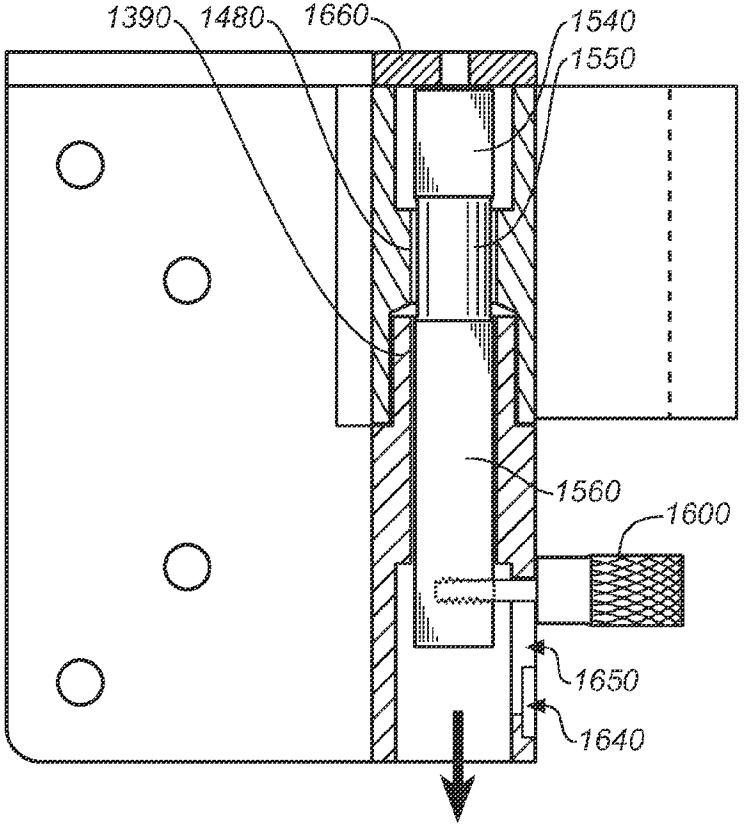
FIG. 24A is a front cross-sectional view showing the hinge in the unlocked position.
Figure 25A:
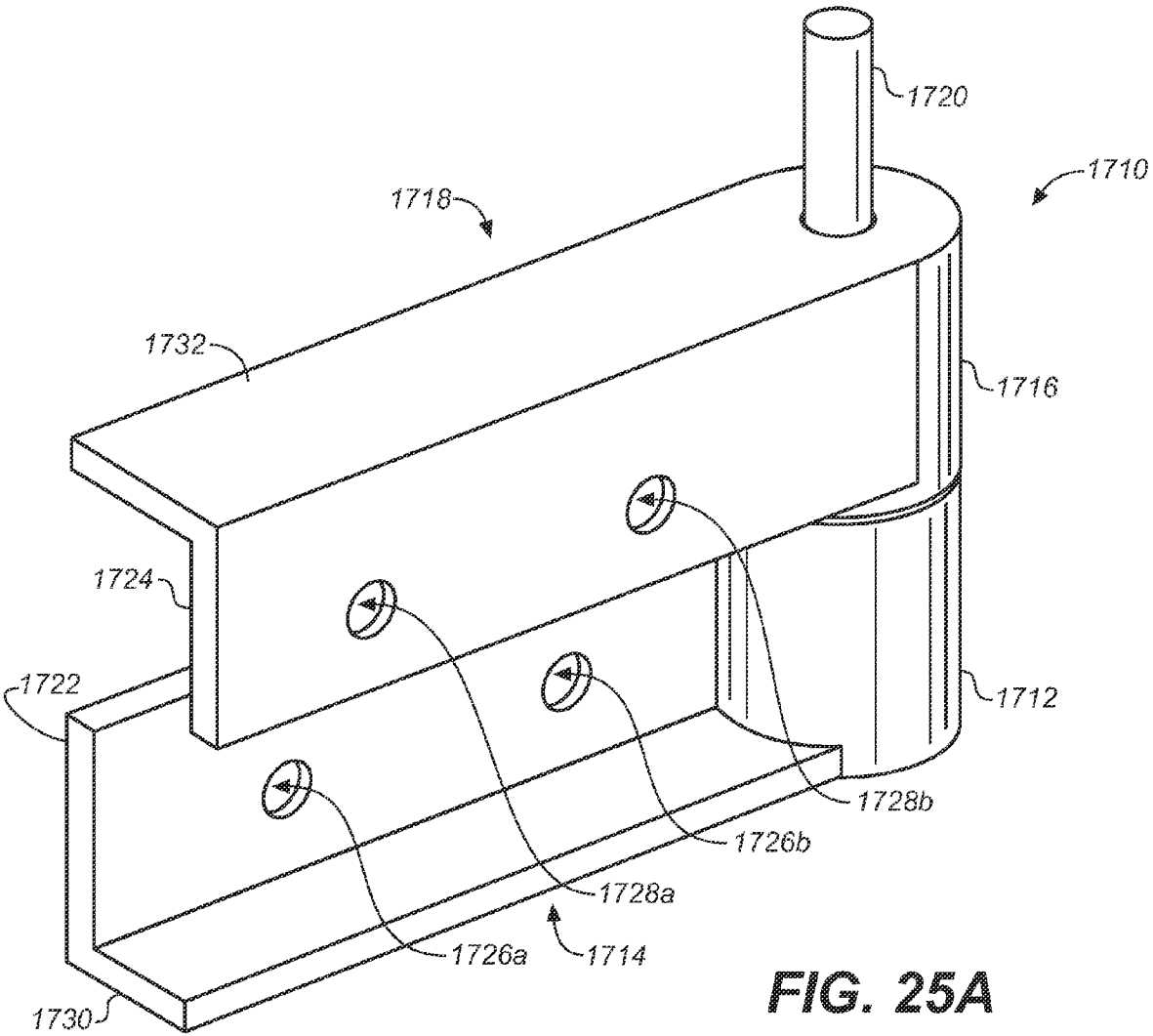
FIG. 25A is an upper front perspective view showing the inventive hinge assembly in a locked position with its mounting wings (leaf elements) closely approximated.
Figure 25B:
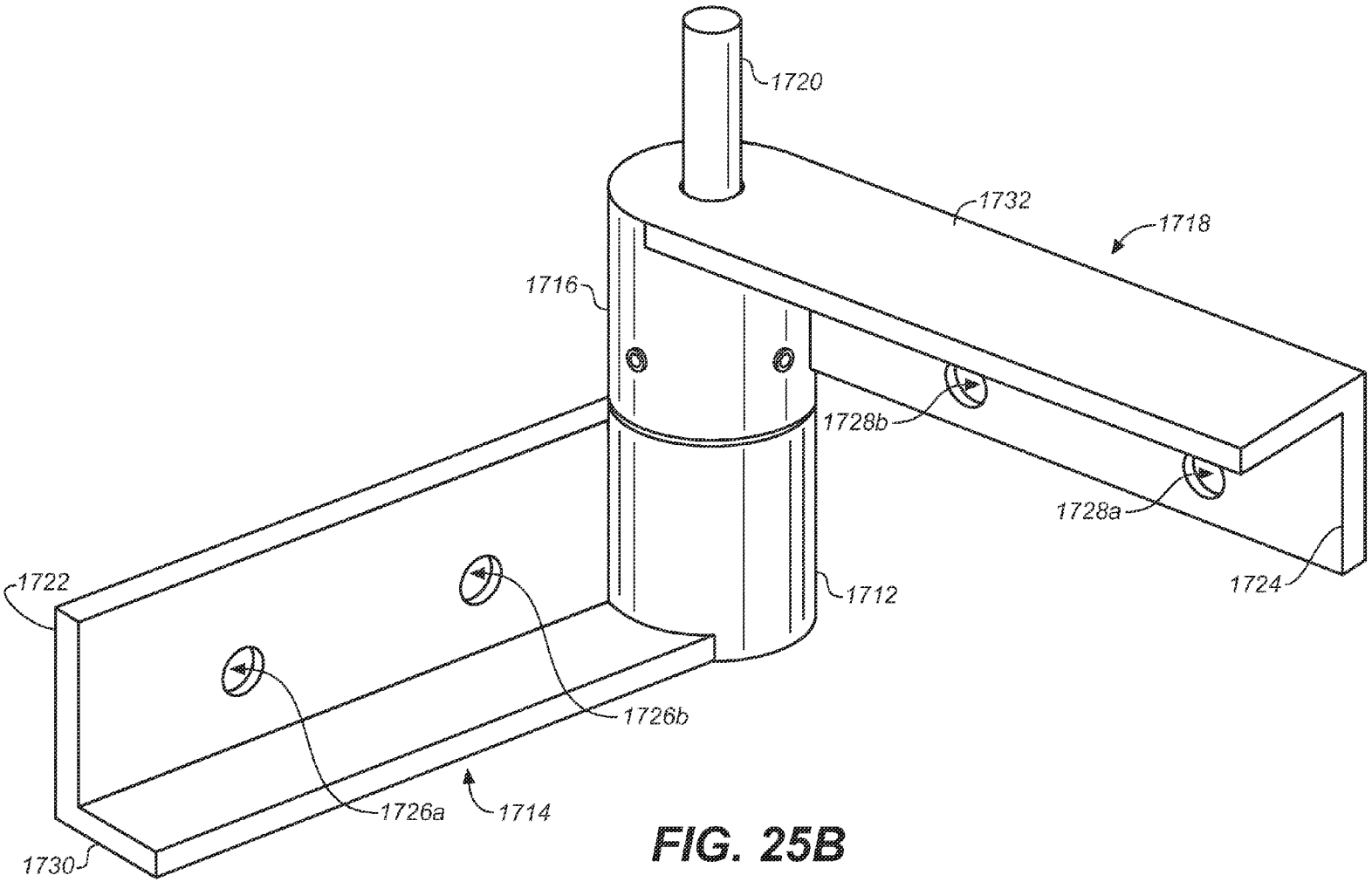
FIG. 25B is an upper front perspective view showing the same assembly in a locked position with the mounting wings moved to a position roughly normal to one another.

Lower sleeve 1400 includes a detent or recess 1640 in which knob 1600 is seated when in the locked position. Referring principally to FIGS. 24A-24B, it will be seen that pulling on knob 1590 compresses spring 1610 and brings base 1590 of knob 1600 out of recess 1640 and allows lock pin 1570 to slide vertically up slot 1650 disposed in the side of lower sleeve 1400. This elevates hinge pin 1530 so as to bring cylindrical medial neck 1550 into the interior space of medial portion 1480 of upper sleeve 1460, thereby unlocking the hinge so as to permit free pivotal movement of the latch leaf portion about the male element 1390 of the first hinge member and on the axis of the hinge pin.

A stopper 1660 comprising a circular cap 1670 with an elongate finger 1680 is screwed onto the upper edge 1690 of hinge leaf 1320 with screws 1700 so as to prevent the two hinge members from separating. This may be fabricated from a metal identical to that of the hinge elements or from a different, harder material according to the anticipated uses for the locking hinge.

Figure 21A:
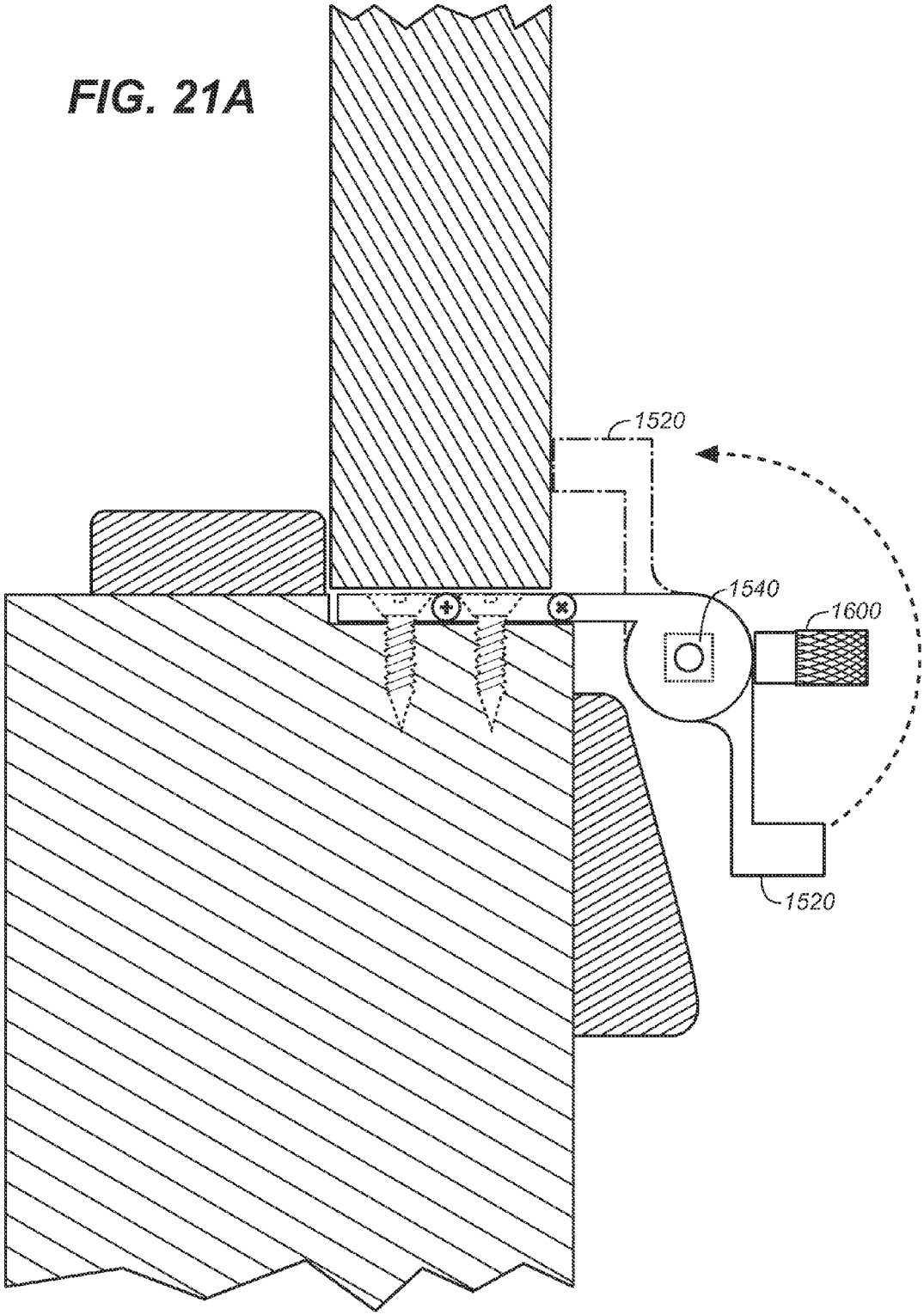
FIG. 21A is a cross-sectional top plan view showing the sixth preferred embodiment installed on a door frame and illustrating the pivot range of the latch leaf from the unlocked to the locked position.
Figure 21B:
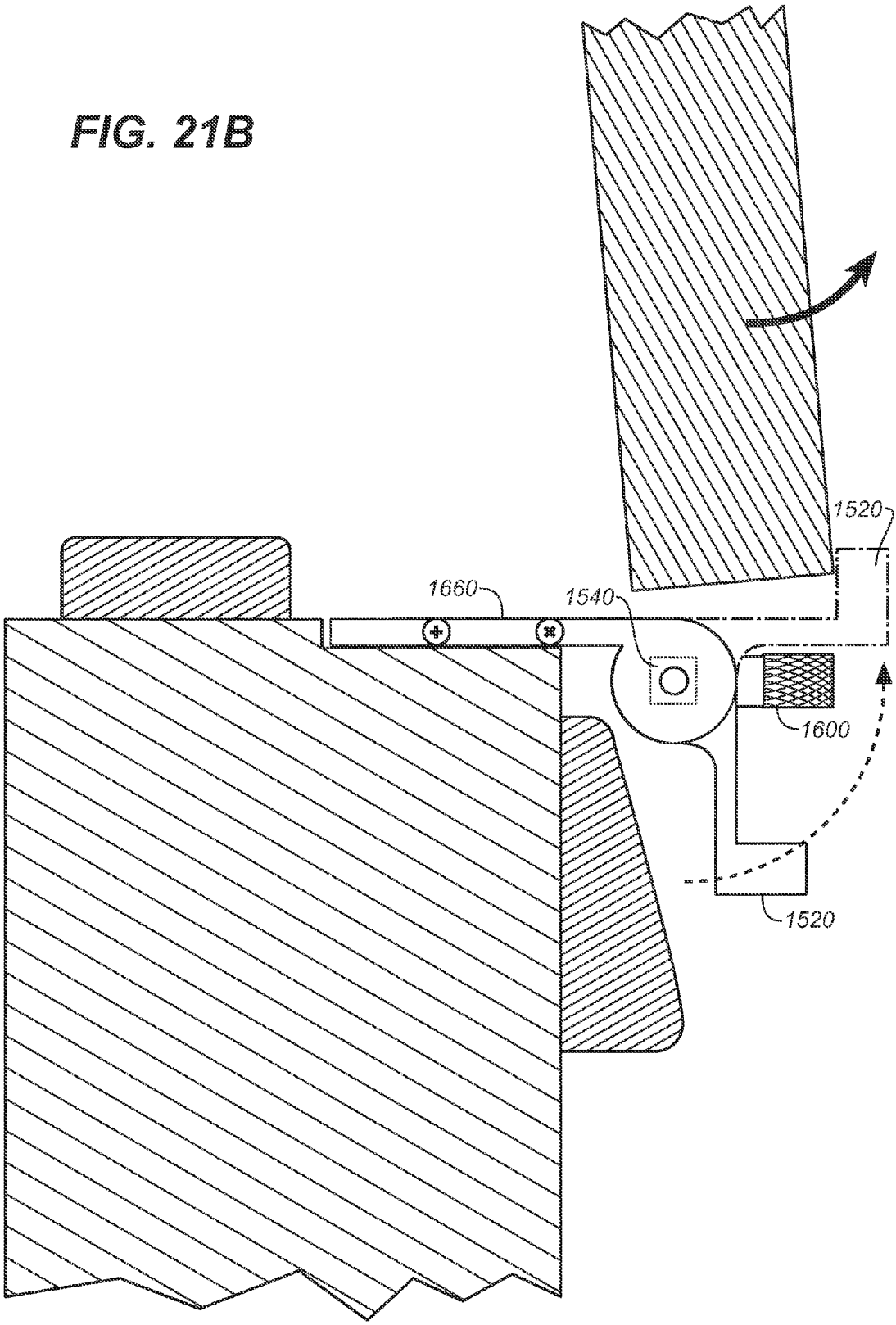
FIG. 21B is the same cross-sectional top plan view showing the latch leaf is a partially opened position.
Figure 22:
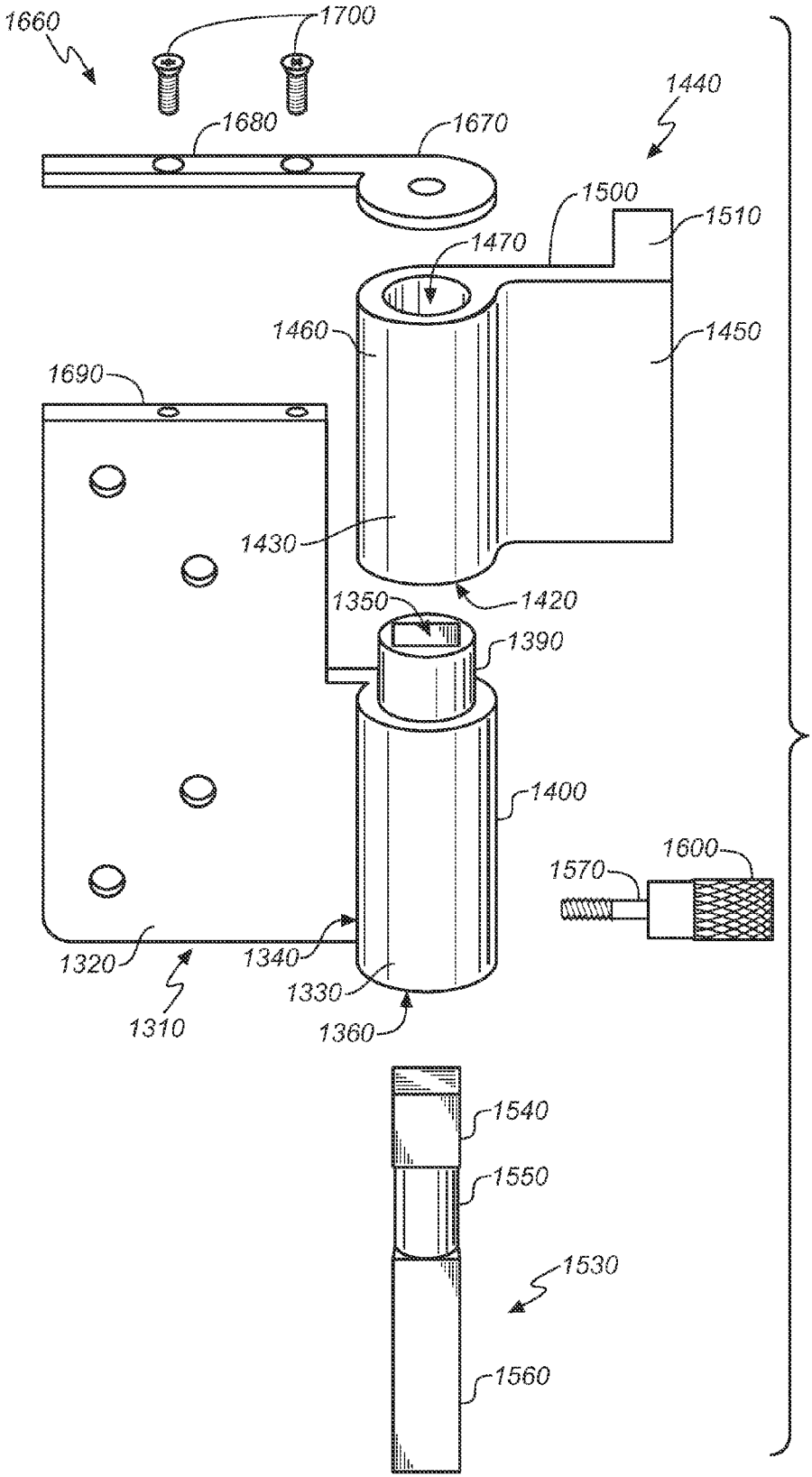
FIG. 22 is an exploded upper front perspective view of the sixth preferred embodiment.

Unique to this embodiment, and as shown in FIG. 21B, the latch leaf may be opened in stages, such that an intermediate "open" position can be achieved, thereby giving an occupant the option of having the door effectively locked (prevented from being opened to a degree needed for ingress and egress, but still allowing the occupant to look through the crack in the partially open door to determine the identity of a person standing outside. It also allows air to be circulated through the opening without having to open the door fully or to leave it unlocked.

As will be readily appreciated, the present invention has nearly unlimited applications well beyond the simple installation on doors for occupied structures. Not only may it be employed for use on lids and closures of virtually any kind, but it can be used as the hinge element for planar members that pivot in position in relation to another planar member, ready examples being workbenches, shelves, partitioning walls, and the like. Other straightforward applications include boat hatches, gates, doors, tool and tackle box lids, and so forth. The possible applications are seemingly endless. This is made more clear by discussion of yet another preferred embodiment of the present invention, illustrated in various views from FIG. 25A through FIG. 36.

Referring next to FIGS. 25A-25B and 27A-27B, there is shown yet another preferred embodiment, a seventh preferred embodiment, of the new and improved locking hinge assembly of the present invention, this embodiment generally denominated 1710 herein. These views show that in this embodiment the inventive hinge assembly includes a first barrel member (eye or gudgeon) 1712 with an attached or integral first wing 1714, a second barrel member 1716 with an attached or integral second wing 1718, and a hinge pin (pintle) 1720 pivotally connecting the first barrel member with the second barrel member. In the embodiment shown in the drawings, either of the wings may function as the fixed wing (attached to a non-moving element) and the other may function as the pivoting (movable) wing (attached to pivoting element). Further, in the embodiment shown, the wings each have an L-shaped cross section, with a first portion 1722, 1724 having through holes 1726*a*, 1726*b*, 1728*a*, 1728*b*, for the insertion of fasteners, and a second portion 1730, 1732, respectively, the second portions being normal to the first portions.

Figure 26:
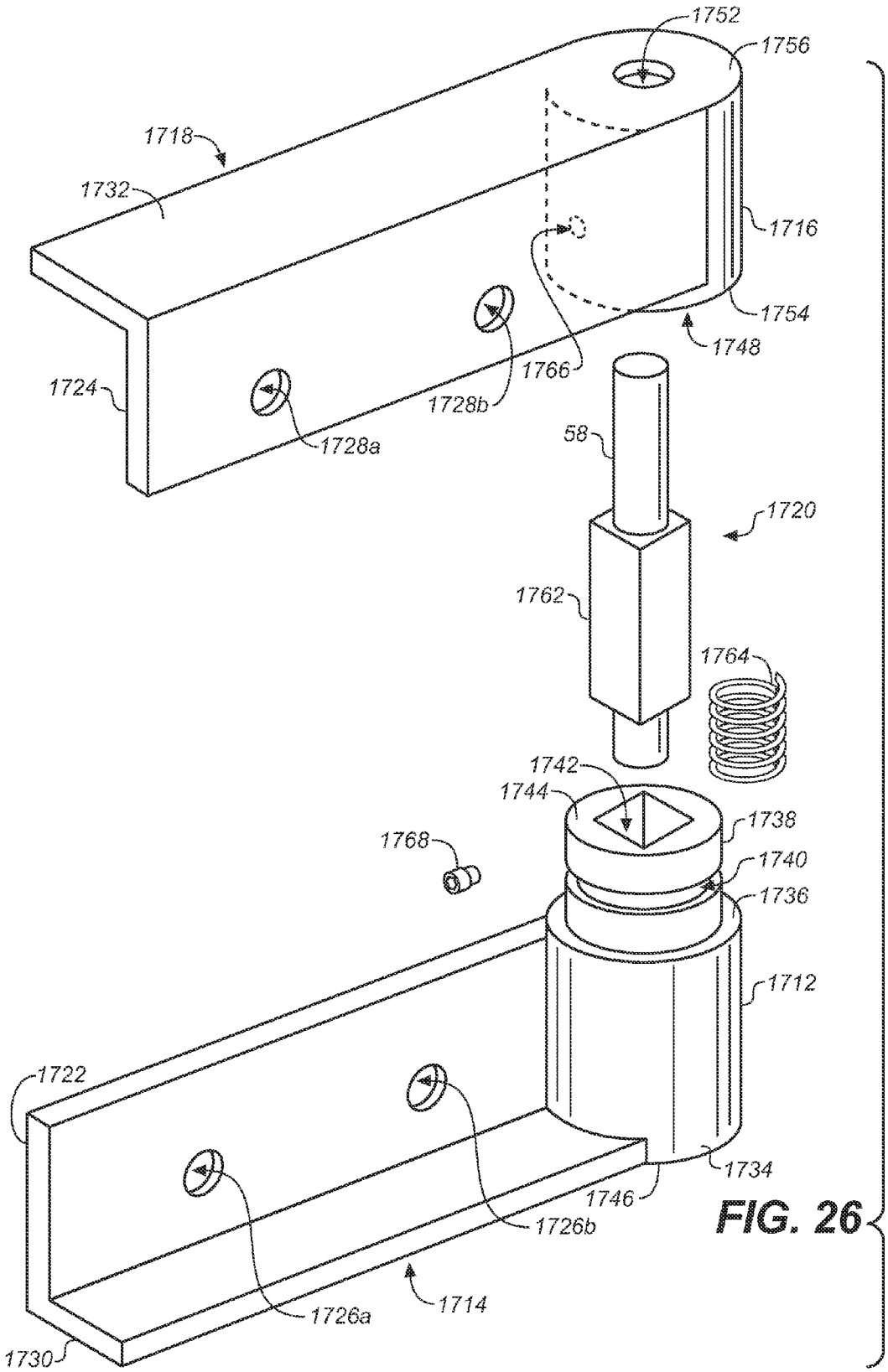
FIG. 26 is an upper front exploded perspective view of the assembly as shown in FIG. 25A.
Figure 27A:
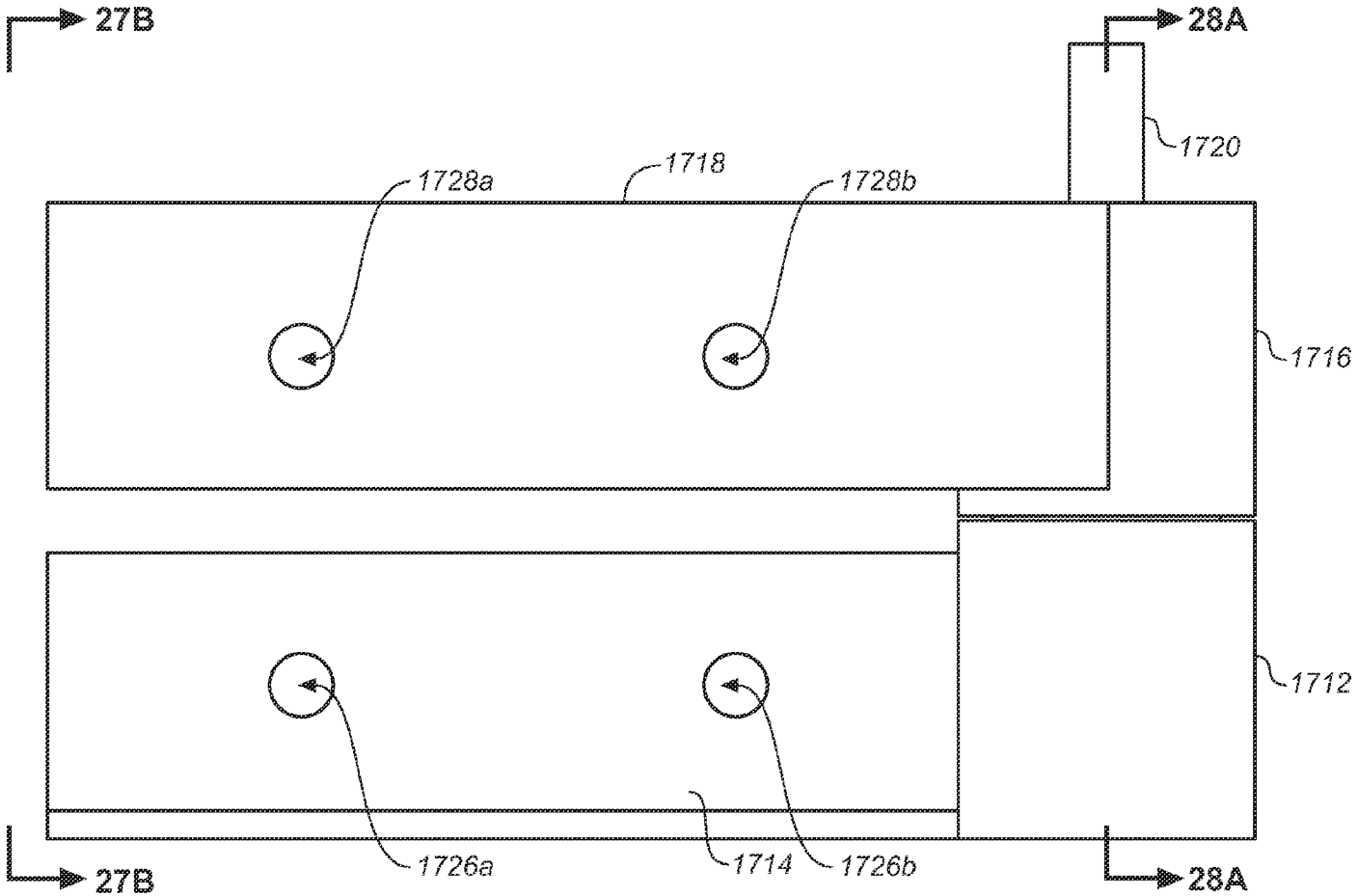
FIG. 27A is a side view in elevation of the assembly of FIG. 25A.
Figure 28B:
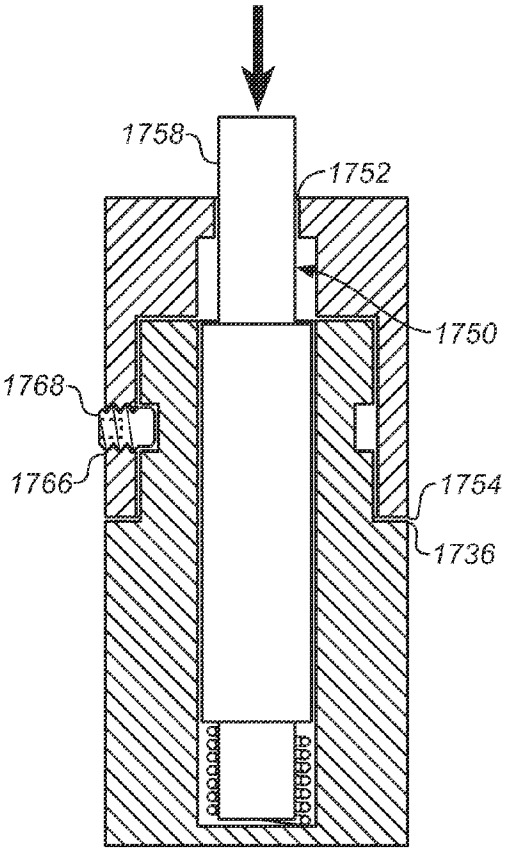
FIG. 28B is a cross-section side view in elevation, also taken along section line 28A-28A of FIG. 27A, showing the locking hinge in the unlocked position.
Figure 28A:
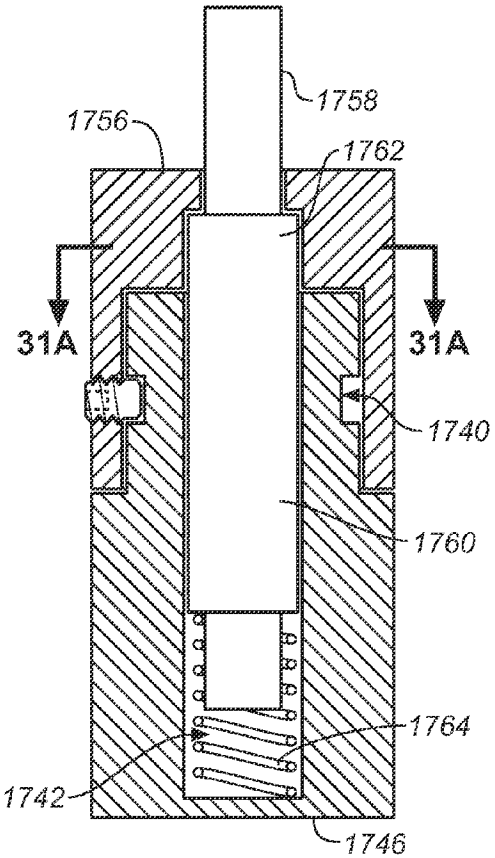
FIG. 28A is a cross-section side view in elevation taken along section line 28A-28A of FIG. 27A, showing details of the barrel elements and the hinge pin of a first preferred embodiment of the inventive locking hinge, this view showing the locking hinge in the locked position.
Figure 27B:
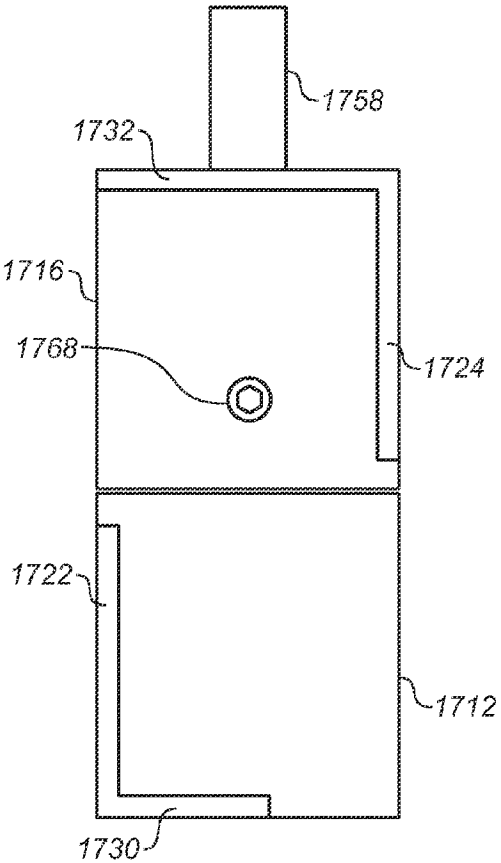
FIG. 27B is a front end view in elevation showing the mounting wings in the configuration shown in FIG. 25A, as viewed along section line 27B-27B of FIG. 27A.

Referring next to FIGS. 26, 28A and 28B, it will be seen that the first barrel member 1172 includes a base portion 1734, which terminates in a shelf 1736, from which a cylindrical male portion 1738 extends. The male portion includes an annular channel 1740. A multi-sided center bore 1742 extends from the top 1744 of the male portion deeply into the first barrel member to a point proximate the generally planar first barrel member end 46. The bore is polygonal and may have any of a number of sides so as to have a cross-sectional shape that is triangular, square, pentagonal, or the like. In the alternative, the bore may also be splined, the selection of shape being determined by the range of motion and number of possible locking positions desired.

The second barrel member 1716 includes a female recess 1748 into which male portion 1738 is inserted. It further includes a multi-sided center bore 1750 shaped and sized identically to that of the multi-side center bore disposed in the first barrel member, and a cylindrical bore 1752, which extends and opens to the exterior of the second barrel member. The inner edge 1754 of the second barrel member is adapted for seating on the shelf 1736 of the first barrel member, while the outer end 1756 is preferably, though not necessarily, planar.

In this preferred embodiment the hinge pin 1720 includes a first cylindrical portion 1758, a second cylindrical portion 1760, and a multi-sided medial portion 1762 disposed between the first and second cylindrical portions. The medial multi-sided medial portion 1762 has a cross-sectional shape identical to that of the multi-sided center bores 1742 and 1750 of the first and second barrel portions, though it is sized slightly smaller for a fit within the center bores with tight clearances. A helical compression spring 1764 is provided for installation around the second cylindrical portion.

In assembly, the helical compression spring 1764 is placed around the second cylindrical portion of the hinge pin or is simply placed in the bottom of the center bore 1742 of the first barrel member and the hinge pin is then inserted into the center bore of the first barrel member. The male portion 38 of the first barrel member is then inserted into the female recess 1748 of the second barrel member 1716 so that the first cylindrical portion 1758 of the hinge pin 1720 extends through the cylindrical bore 1752 of the second barrel member. The second barrel portion is provided with one or more threaded holes 1766 disposed at the level of the annular channel 1740 of the male portion 1738 of the first barrel member, and a locking screw 1768 is threadably into the one or more holes so as to engage the channel and capture the male portion within the female recess. The screws are tightened only enough to keep the barrel members coupled, but not so tight as to prevent free rotation of one barrel member in relation to the other.

Then, in assembly, when the sides of the multi-sided center bore of each of the first and second barrel members are brought into alignment, the spring 1764 will urge and upper portion of the medial multi-sided portion 1762 of the hinge pin into the multi-sided center bore of the second barrel portion and the first cylindrical portion 1758 will extend outwardly from the second barrel member, as seen in FIG. 28A. This is the locked position, wherein the medial multi-sided portion of the hinge pin is inserted into each of the multi-side center bores of the first and second barrel members. The barrel members and thus prevented from rotation in relation to one another.

When it is desired to rotate the wing elements in relation to one another (and thus any structure that may be affixed to the respective wing elements), the hinge pin is simply pushed inwardly, as shown in FIG. 28B, which moves the medial multi-sided portion of the hinge pin out of the multi-sided center bore 1750 of the second barrel member 1716 and exclusively into the multi-sided center bore 1742 of the first barrel member 1712. Any rotation of the barrel members in relation to one another when the hinge pin is in the unlocked position will bring the sides of the respective multi-sided center bores out of alignment and prevent the multi-sided medial portion 1762 of the hinge pin 1720 from returning into engagement with the multi-sided center bore 1750 of the second barrel member 1716. Accordingly, throughout a predetermined range of motion, the hinge will rotate freely until the sides of the multi-sided center bores are again in alignment, at which point if the hinge pin is not still pushed into the unlocked position, the spring will again urge the hinge pin upwardly into the locked position, which would be the next in order locking position. Proceeding to rotate the pivoting wing of the locking hinge beyond this point will require that the hinge pin again be pushed so as to disengage the multi-sided medial portion of the hinge pin from the multi-sided center bore of the second barrel member.

Figure 29B:
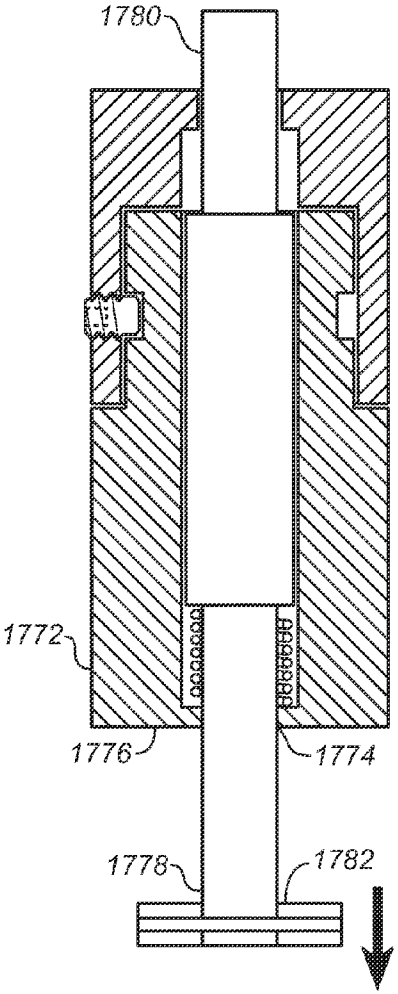
FIG. 29B is a cross-sectional side view in elevation of the assembly of FIG. 29A, showing the locking hinge in the unlocked position.
Figure 29A:
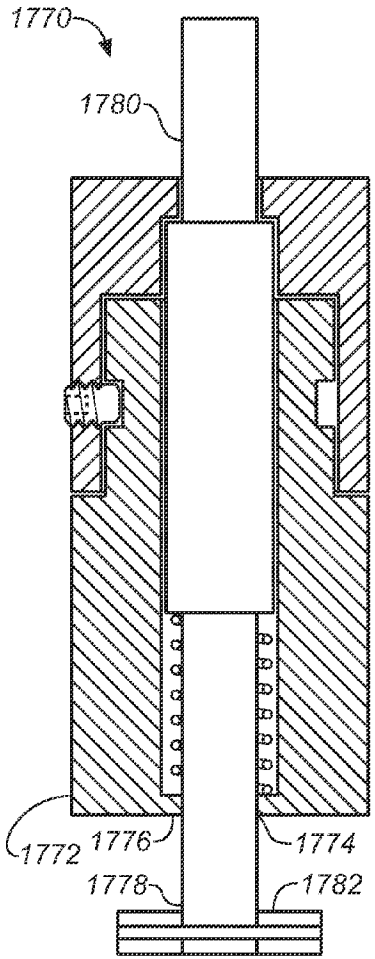
FIG. 29A is a cross-sectional side view in elevation showing a second preferred embodiment of the locking hinge with a hinge pin with push and pull options, this view showing the locking hinge in the locked position.

Referring next to FIGS. 29A-29B, in an eighth preferred embodiment 1770 of the inventive locking hinge, all elements are substantially identical to those of the seventh preferred embodiment. However, the first barrel member 1772 is modified to include a cylindrical opening 1774 in its end 1776, through which the second cylindrical portion 1778 of a modified hinge pin 1780 extends. A knob or grip 1782 is provided on the end of the second cylindrical portion so as to permit unlocking of the hinge either with a pulling action (i.e., by pulling the knob 1782, as shown in FIG. 29B) or a pushing action, as described above.

Figure 30B:
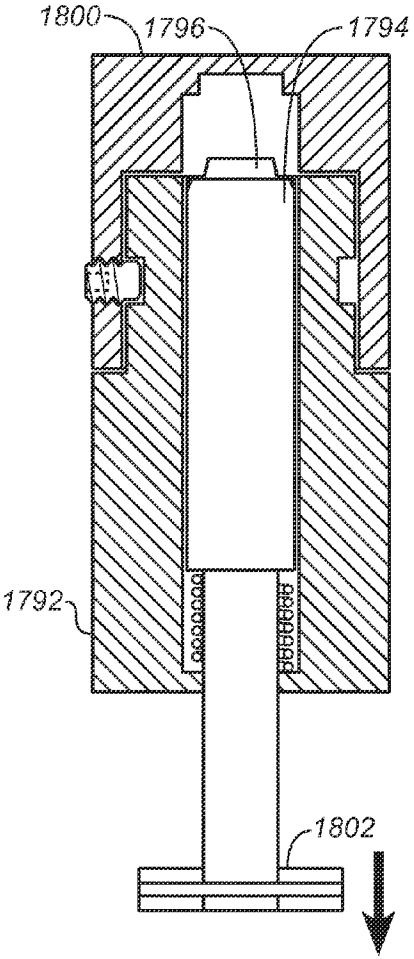
FIG. 30B is a cross-sectional side view in elevation of the assembly of FIG. 30A, showing the locking hinge in the unlocked position.
Figure 30A:
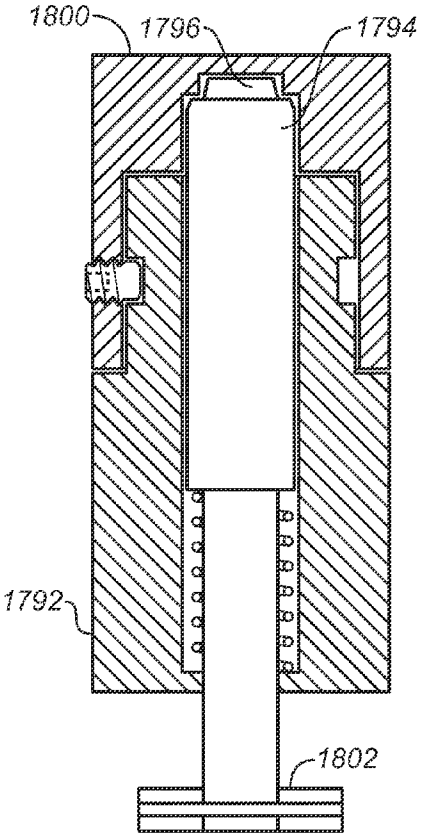
FIG. 30A is a cross-sectional side view in elevation of a third preferred embodiment showing a pull only hinge pin, this view showing the locking hinge in the locked position.

Referring next to FIGS. 30A-30B, in a ninth preferred embodiment 1790, the first barrel member 1792 is substantially identical to that of the eighth preferred embodiment of FIGS. 29A-29B, but the hinge pin 1794 is modified to have a truncated first cylindrical portion 1796, and the second barrel member 1798 is modified to have a closed end 1800. Accordingly, the only unlocking action comprises a pulling action by knob 1802, as shown in FIG. 30B.

Figure 31:
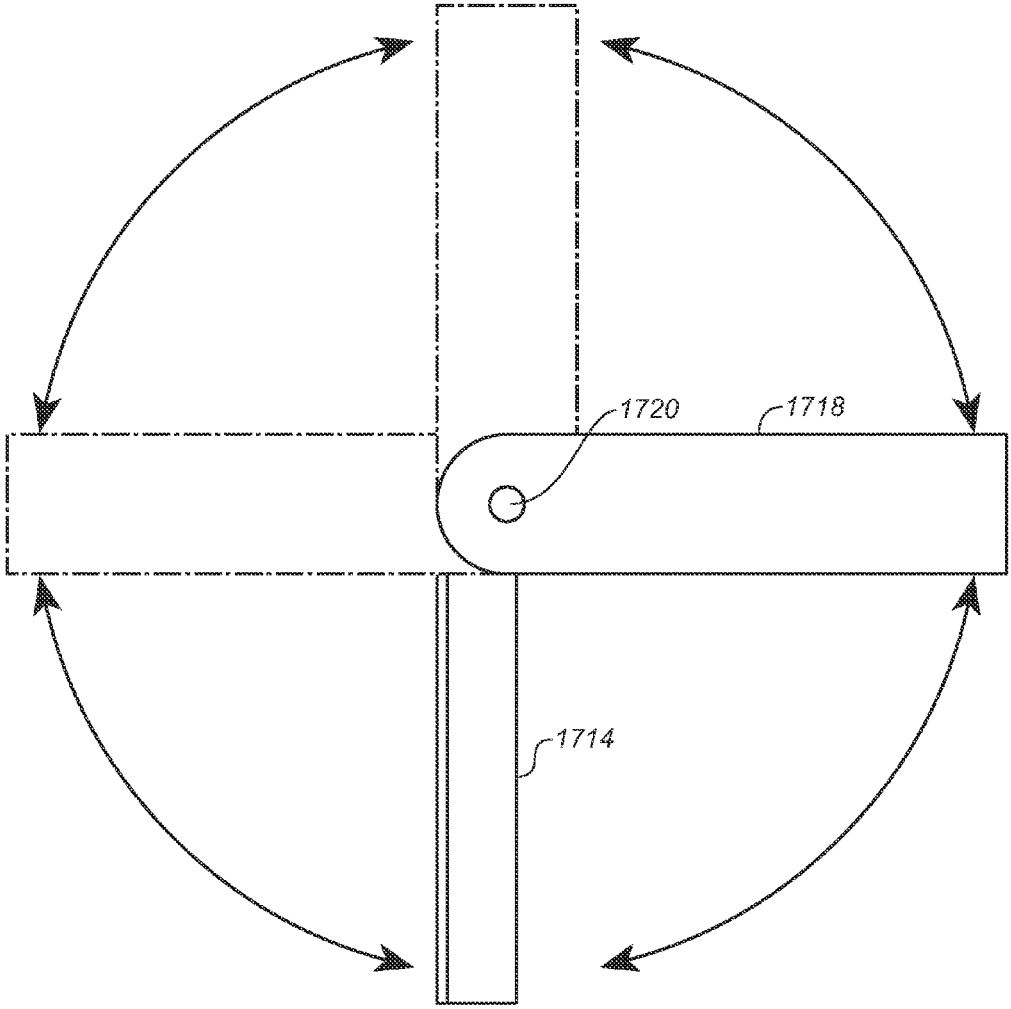
FIG. 31 is a top plan view showing the range of motion and lockable stop positions of the locking hinge having a hinge pin with a square cross-sectional shape and configured for 90 degree arc sweeps.
Figure 31A:
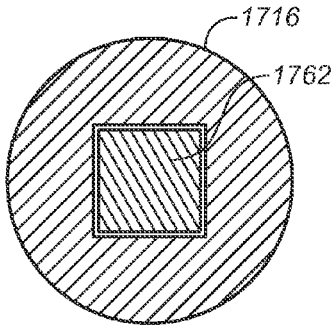
FIG. 31A is a cross-sectional top plan view showing the barrel and hinge pin of the first preferred embodiment of the locking hinge as taken along section lines 31A-31A of FIG. 28A.

FIGS. 31 and 31A show the range of motion possible with a hinge pin 1720 having a multi-sided medial portion 1762 and multi-sided center bores each with a square cross-sectional shape. As will be appreciated, stops or locking points are provided every 90 degrees of motion of the wing elements 1714, 1718, in relation to one another.

Figure 32:
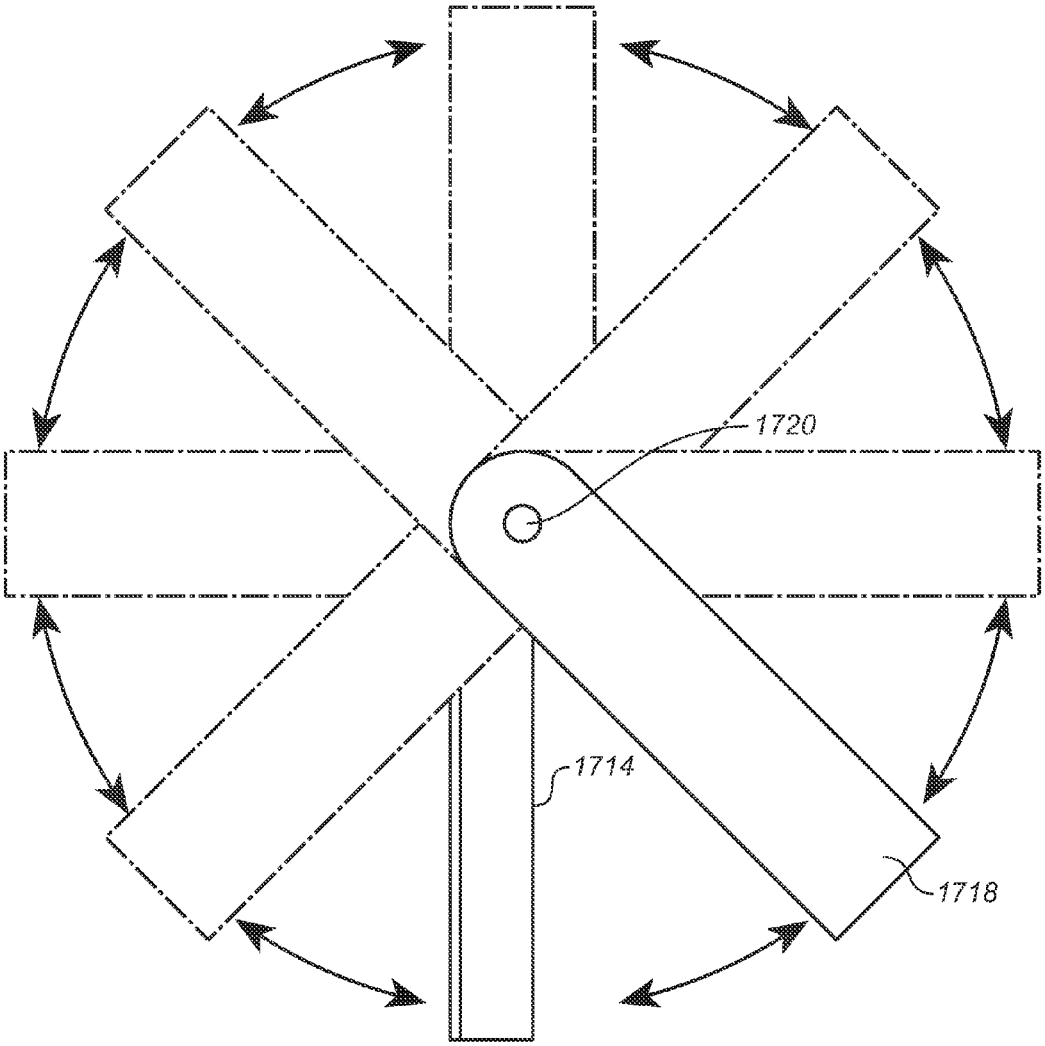
FIG. 32 is a top plan view showing the range of motion and lockable stop positions of the locking hinge having a hinge pin with an octagonal cross-sectional shape and configured for 45 degree arc sweeps.
Figure 32A:
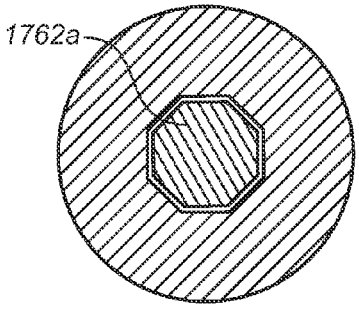
FIG. 32A is a cross-sectional top plan view showing the barrel and hinge pin of the embodiment of FIG. 32 showing a hinge pin with an octagonal cross-sectional shape.
Figure 33A:
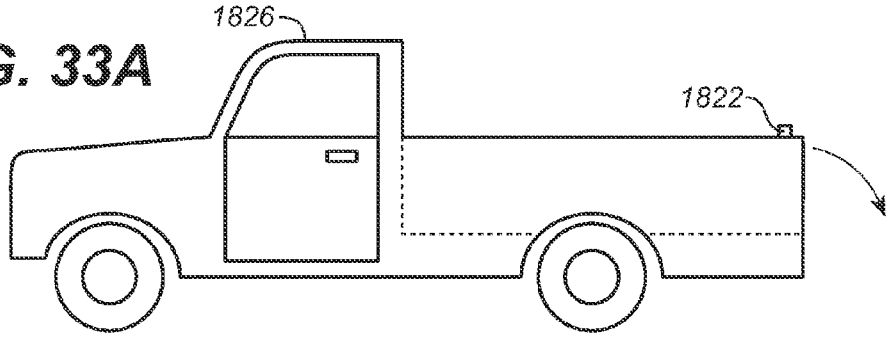
FIG. 33A is a schematic side view in elevation showing the inventive locking hinge implemented in a multi-position tailgate extension, this view showing the tailgate in the raised position and the tailgate extension in an undeployed configuration.
Figure 33B:
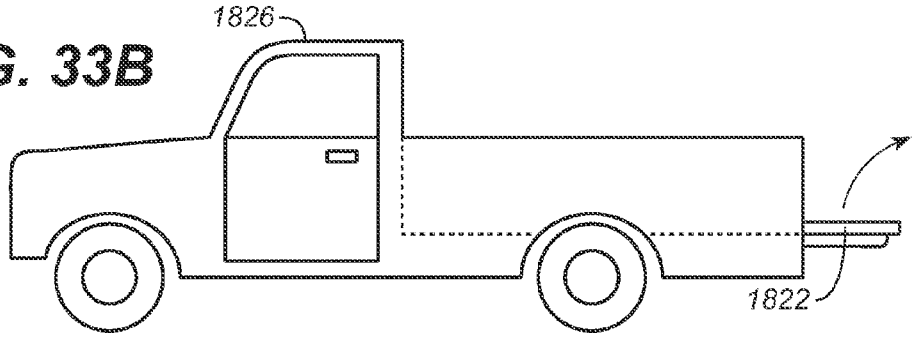
FIG. 33B is a schematic side view in elevation showing the tailgate down and indicating the direction for deployment of the extension.
Figure 33C:
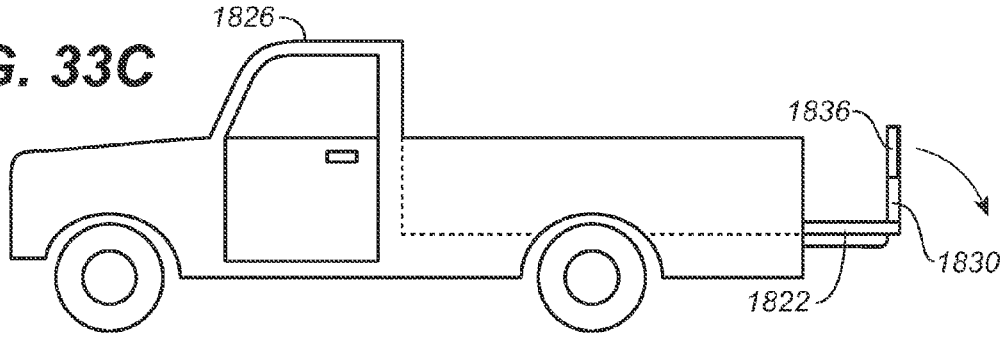
FIG. 33C is a schematic side view in elevation showing the tailgate pivoted 90 degrees to a first stop position, such that the extension panel is in a generally vertical orientation above the tailgate and with the inner side facing the truck cab.
Figure 33D:
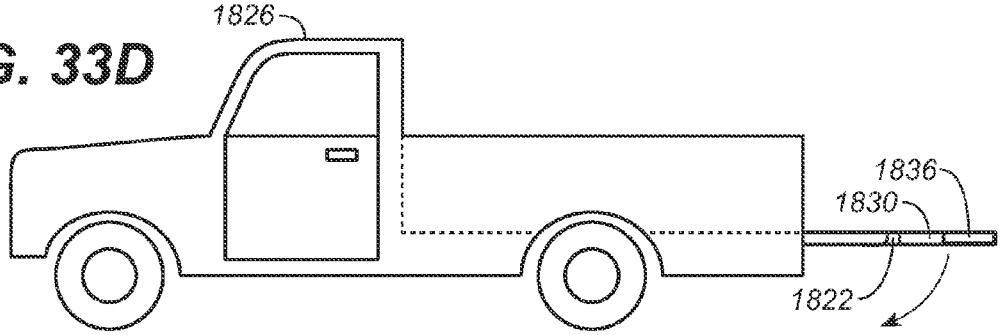
FIG. 33D is a schematic side view in elevation showing tailgate extension with the extension panel in the fully extended position.
Figure 33E:
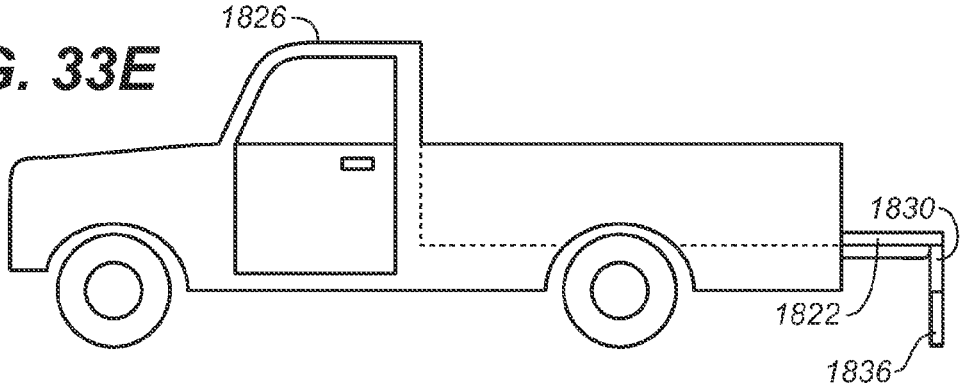
FIG. 33E is a schematic side view in elevation showing tailgate extension with the extension panel is in a generally vertical orientation below the tailgate and with the inner side facing away from the truck cab.
Figure 33F:
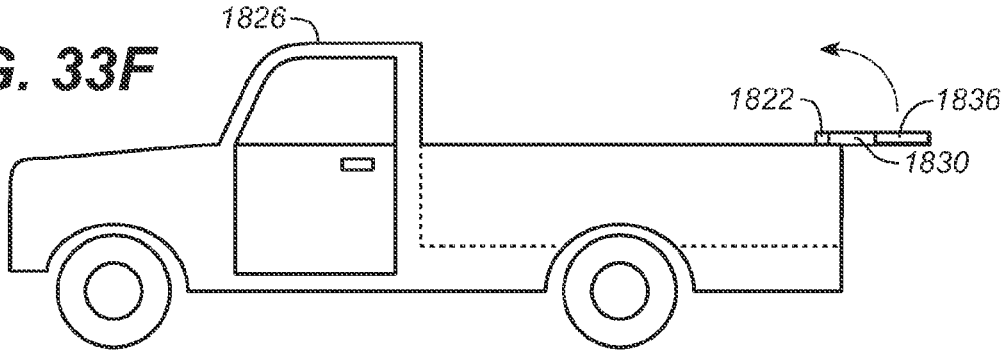
FIG. 33F indicates how the tailgate may be closed to place the tailgate extension in a position offering a high platform or workbench.
Figure 33G:
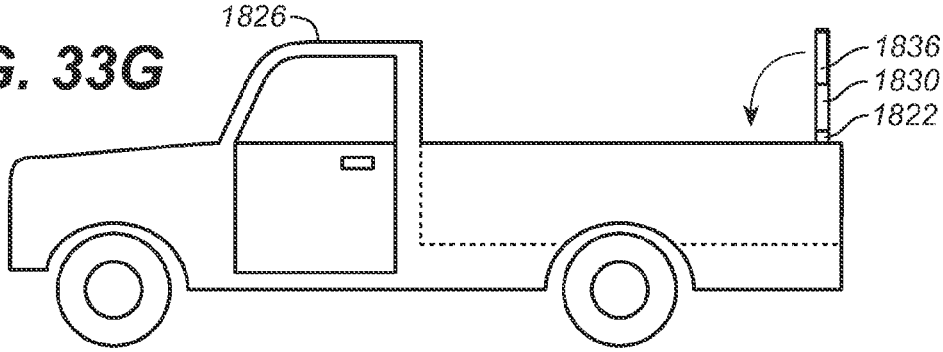
FIG. 33G shows the tailgate extension configuration when the tailgate is closed from the configuration shown in FIGS. 33E and 33F.
Figure 33H:
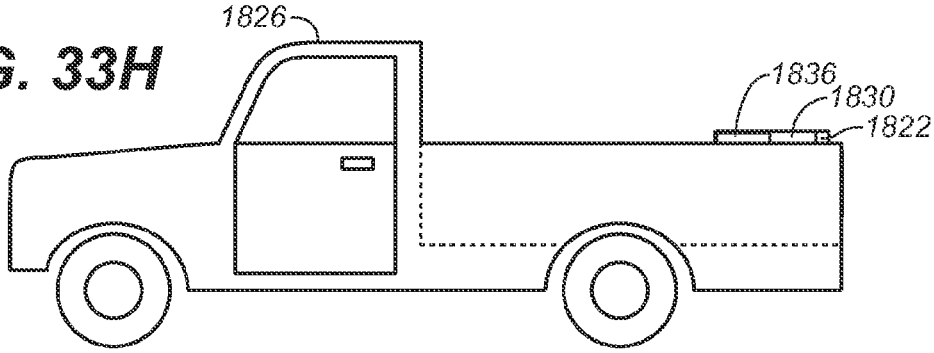
FIG. 33H shows multi-position tailgate extension with the tailgate returned to the raised position and the tailgate extension again in an undeployed configuration.
Figure 34A:
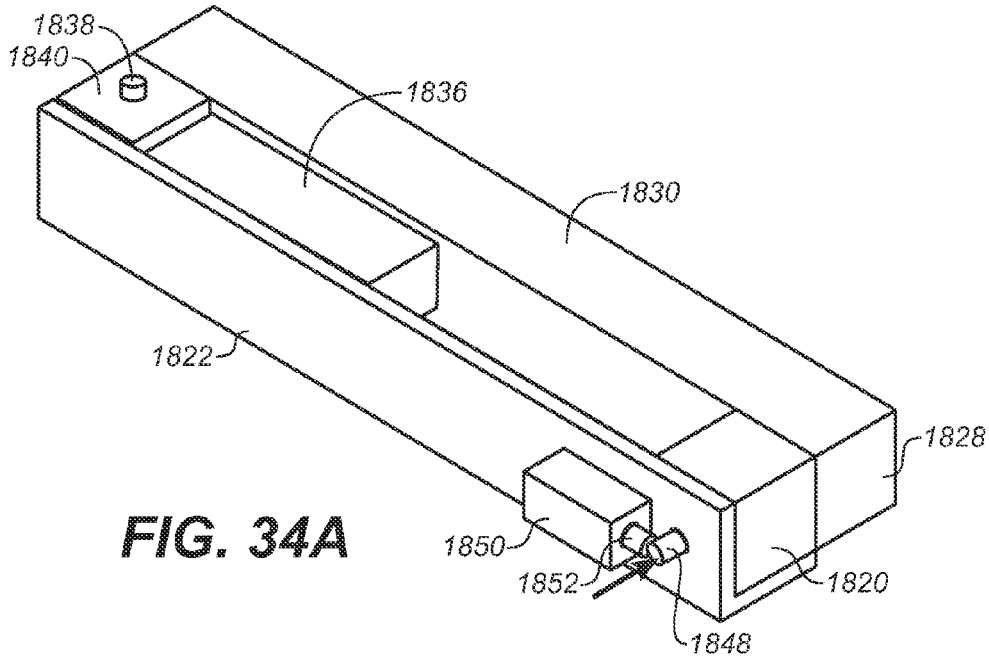
FIG. 34A is an upper perspective view showing details of the locking hinge as implemented in the tailgate extension of FIGS. 33A-33H, and showing, more particularly, the hinge pin and spring actuated pin lock that holds the hinge pin in a depressed position and showing a foot step nested between the fixed and pivoting wings.
Figure 34B:
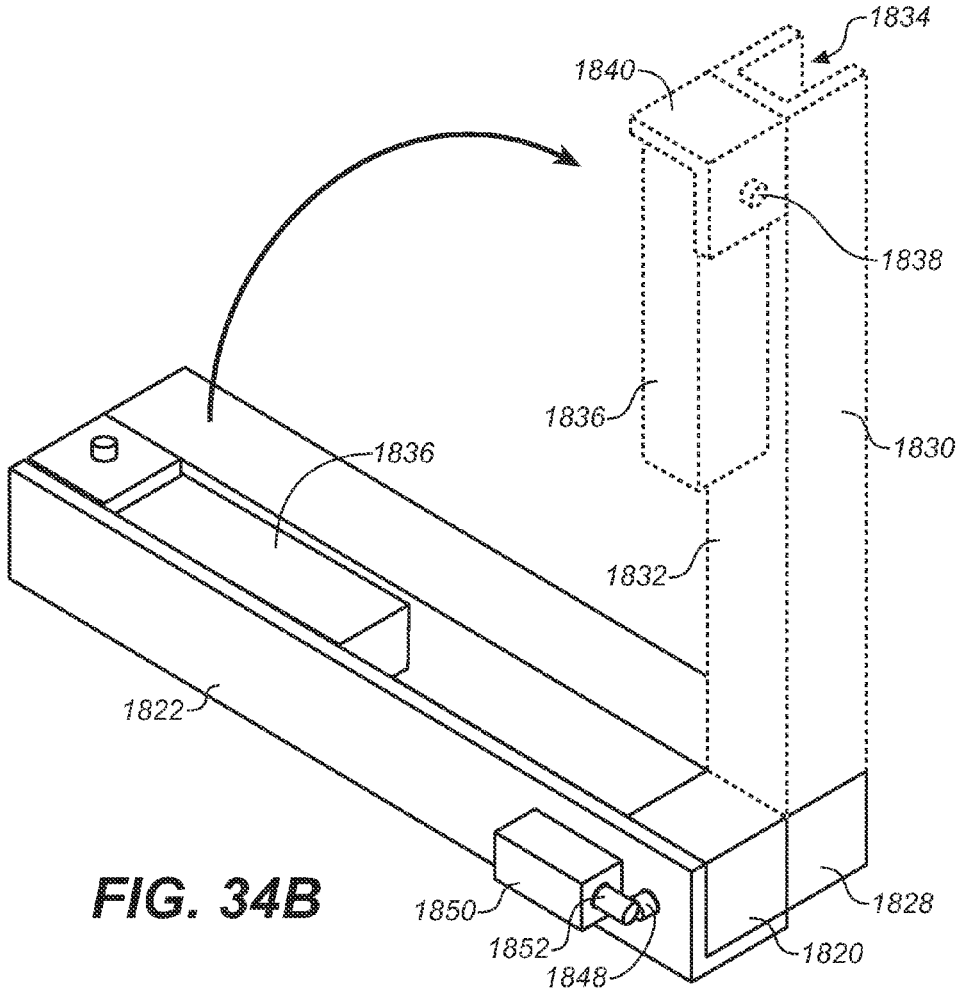
FIG. 34B shows radial translation of the pivoting wing of the locking hinge when the locking pin is depressed into the unlocked position.
Figure 35:
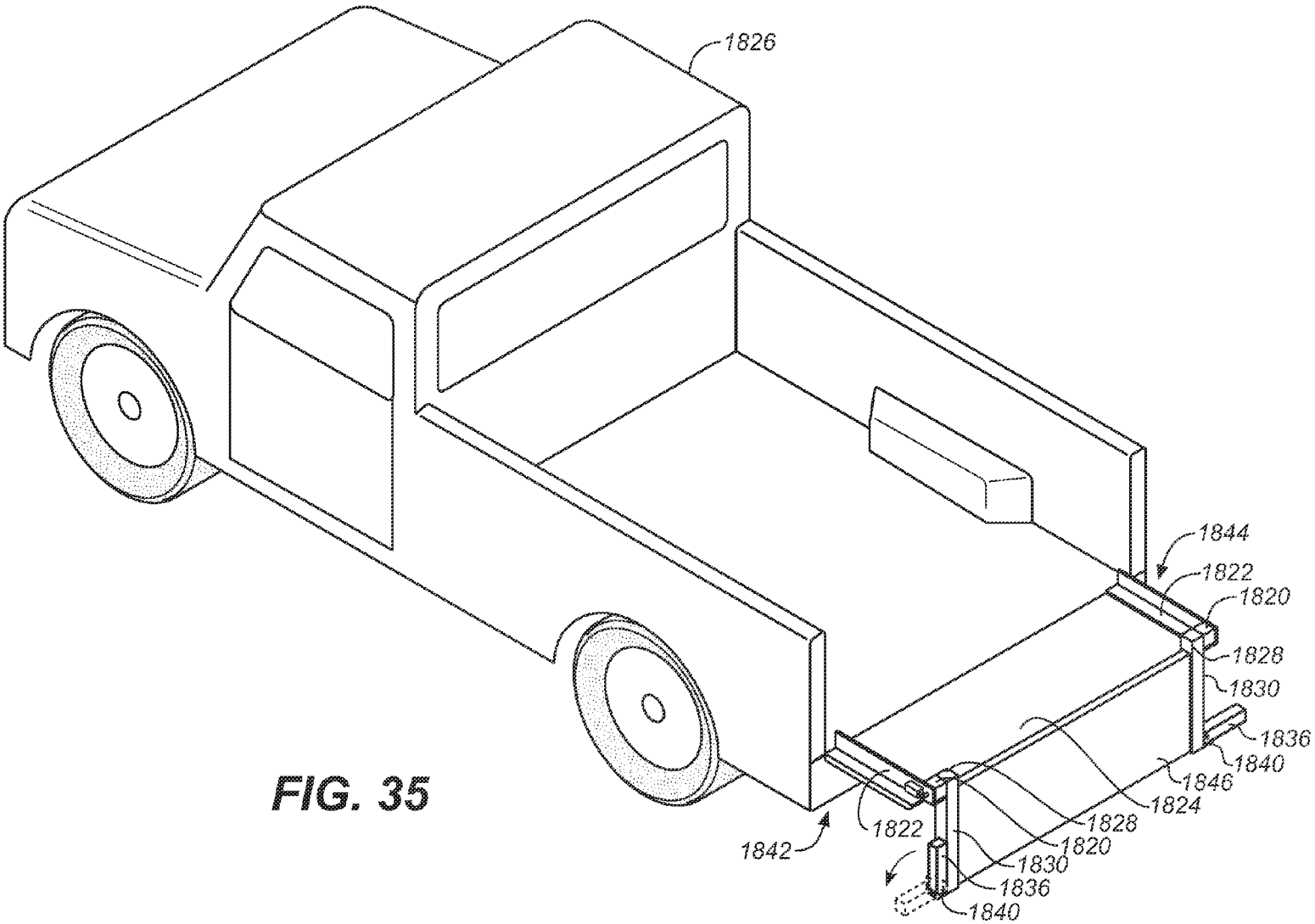
FIG. 35 is a perspective view showing the tailgate extension in the fully deployed position with the extension panel oriented vertically below the tailgate and one two tailgate foot steps deployed.
Figure 36:
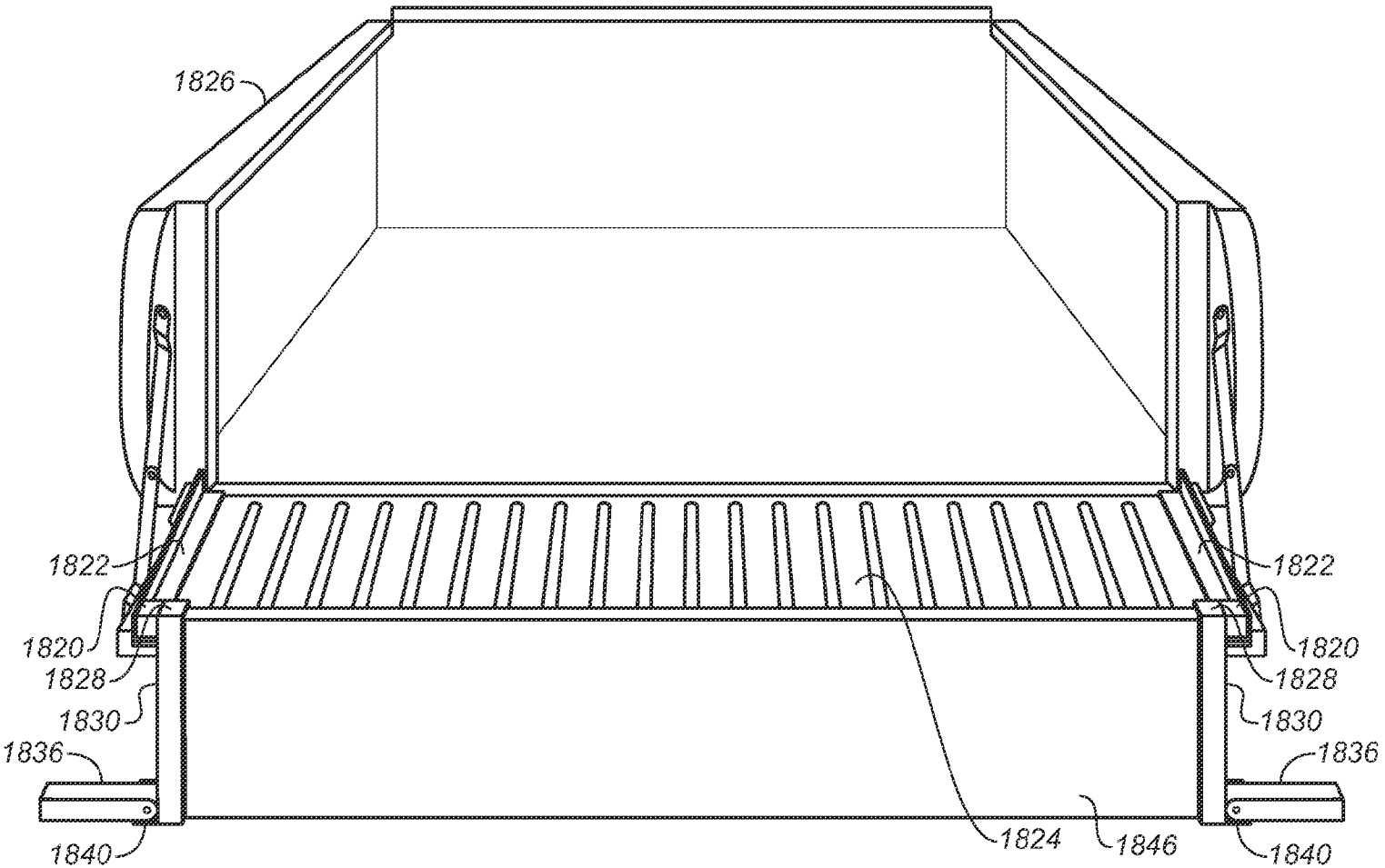
FIG. 36 is a rear perspective view thereof with both foot steps deployed.
Figure 37A:
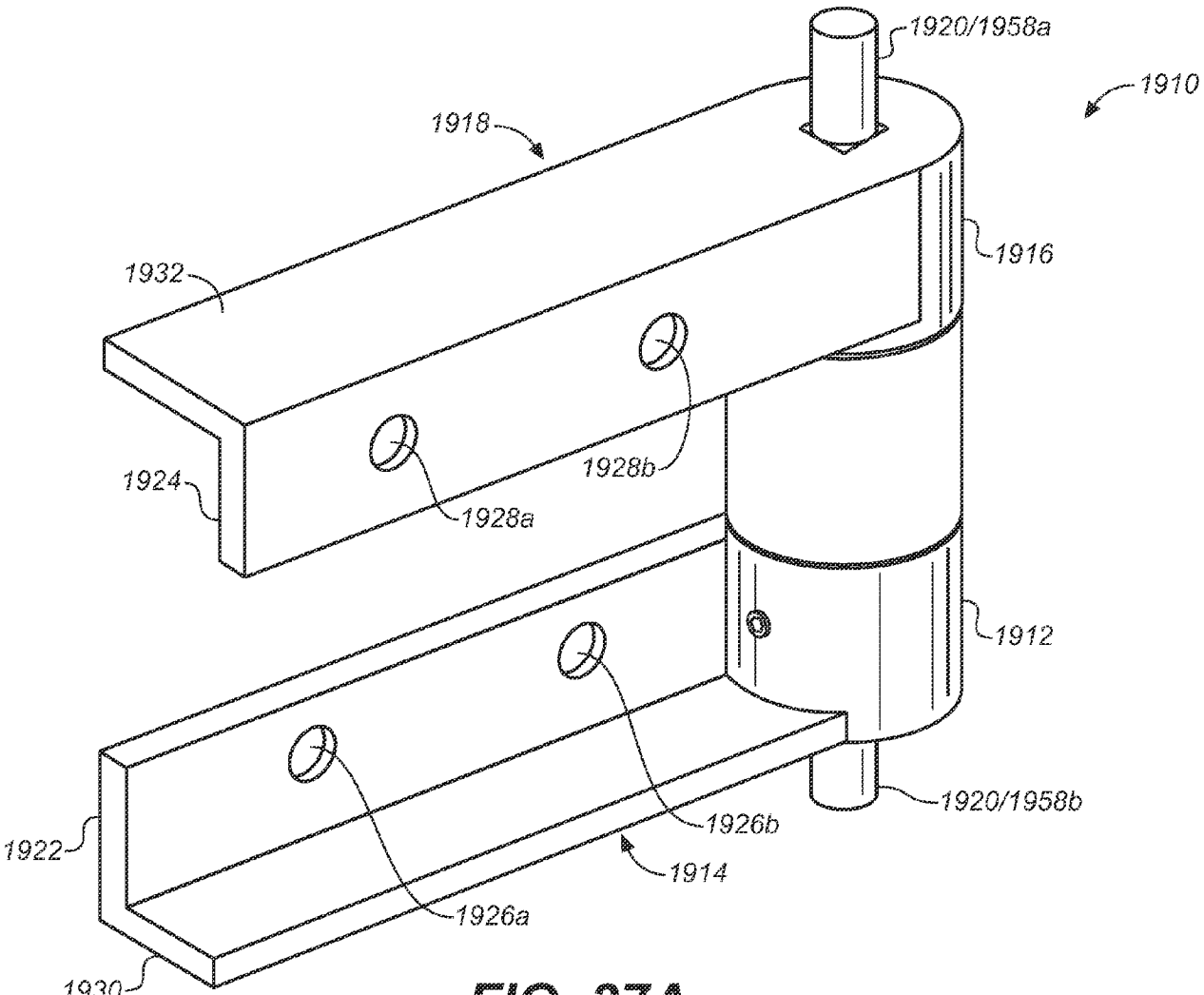
FIG. 37A is an upper front perspective view showing the inventive hinge assembly in a locked position with its mounting wings (leaf elements) closely approximated.
Figure 37B:
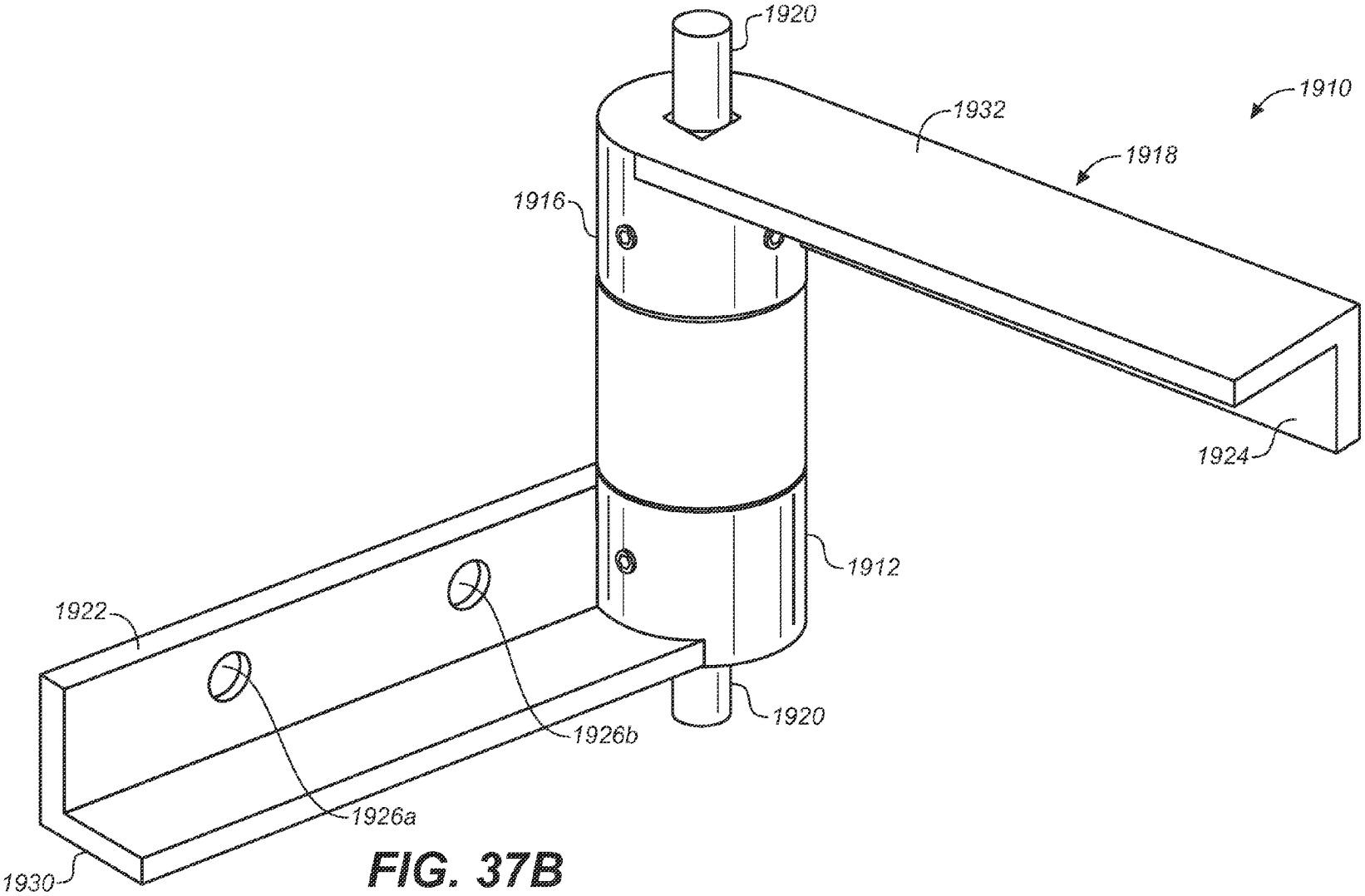
FIG. 37B is an upper front perspective view showing the same assembly in a locked position with the mounting wings moved to a position roughly normal to one another.

FIGS. 32 and 32A show the range of motion possible with a hinge pin 1720 having a multi-sided medial portion 1762*a* and multi-sided center bores each with an octagonal cross-sectional shape. In this configuration, stops or locking points are provided every 45 degrees of motion of the wing elements 1714, 1718, in relation to one another.

Referring next to FIGS. 33A-36, there are shown various views of the inventive locking hinge implemented in a multi-position tailgate extension. FIGS. 34A-34B shown how the locking hinge is configured to accomplish this implementation. These latter views show that the first barrel member 1820 is attached to the fixed wing 1822, which is an L-shaped metal bracket affixed to the interior side 1824 of a pick up truck 1826. The second barrel member 1828 is attached to a pivoting wing 1830, which is preferably a U-shaped metal channel, with the channel 1832 facing in the inboard direction. On the outboard side 1834 of the pivoting wing is a step 1836, pivotally attached to the pivoting wing with an axle 1838 disposed through a bracket 1840 and the step. The step can pivot out 90 degrees, where further rotation is prevented by the bracket. This assembly is provided for the left (driver's) side installation 1842 on the tailgate. A mirror image 1844 of this assembly is provided for the right (passenger's) side installation. Together, the inboard facing channels provide structure for mounting and affixing a panel 1846 between the hinge assemblies. This panel has many possible uses, including use as a simple tailgate extension. When the wing elements are rotated 180 degrees to one another. However, countless other uses are contemplated for various positions within its possible range of motion.

In this implementation, rotation of the pivoting wing 1830 in relation to the fixed wing 1822 is accomplished by pushing the hinge pin 1848, the mechanics of which are described above in connection with the seventh and ninth preferred embodiments of the inventive locking hinge. However, because the span from the left to the right side assembly may be too long for many people to reach each hinge pin for release, at least one of the assemblies is provided with a trigger lock 1850, which includes a spring-actuated plunger 1852, which extends to lock hinge pin 1848 in the depressed (unlocked) position until it (the plunger) is itself depressed. Accordingly, while hinge pin 1848 is retained in the unlocked position, the user can move to the other assembly and depress the hinge pin in that assembly so that both hinges are in the unlocked position, and the extension panel 1846 can then be pivoted freely until a first stop position is reached, at which point the hinge pin not depressed by the trigger lock will click back into a locked position (provided, however, that the user has not himself or herself continued to depress the second hinge pin).

FIGS. 33A through 33H show some, but not all, of the positions that the tailgate extension can be moved into with the above-described installation.

Referring next to FIGS. 37A-37B and 39-40, there is shown yet another (tenth) preferred embodiment of the new and improved locking hinge assembly of the present invention, this embodiment generally denominated 1910 herein. These views show that in this embodiment the inventive hinge assembly includes a first or lower barrel member (eye or gudgeon) 1912 with an attached or integral first or lower wing 1914, a second, upper, barrel member 1916 with an attached or integral second, upper, wing 1918, and a split hinge pin (pintle) 1920 (denominated 1920*a*, 1920*b*, respectively in subsequent views) pivotally and operatively connecting the first barrel member with the second barrel member via a medial barrel member 1935. In the embodiment shown in the drawings, either or both of the wings may function as a fixed or a moving wing, either alone or in combination, and either separately or at the same time. As before, the wings preferably have an L-shaped cross section, with a first portion 1922, 1924 having through holes 1926*a*, 1926*b*, 1928*a*, 1928*b*, for the insertion of fasteners, and a second portion 1930, 1932, respectively, the second portions being normal to the first portions.

Figure 38:
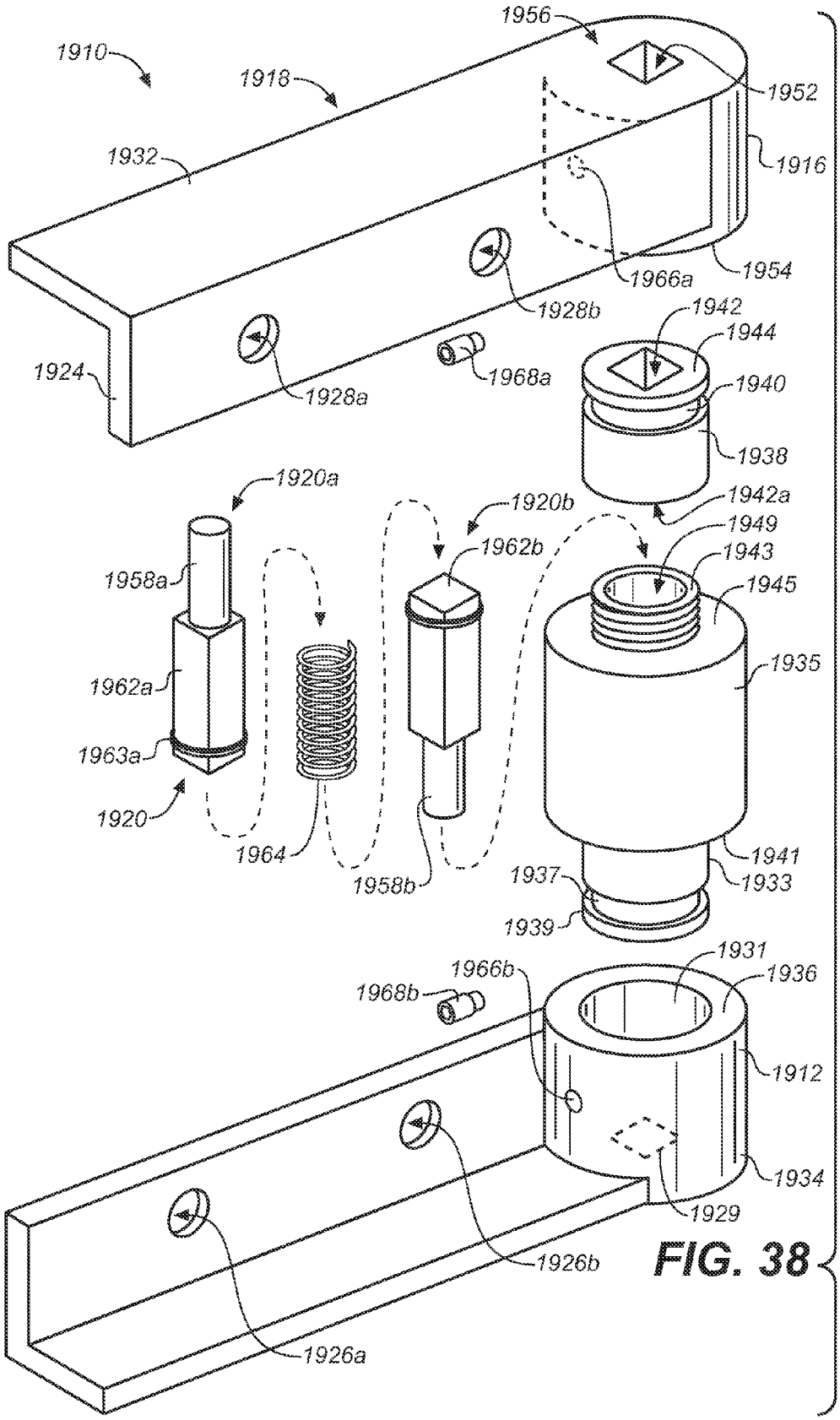
FIG. 38 is an upper front exploded perspective view of the assembly as shown in FIG. 27A.
Figure 40:
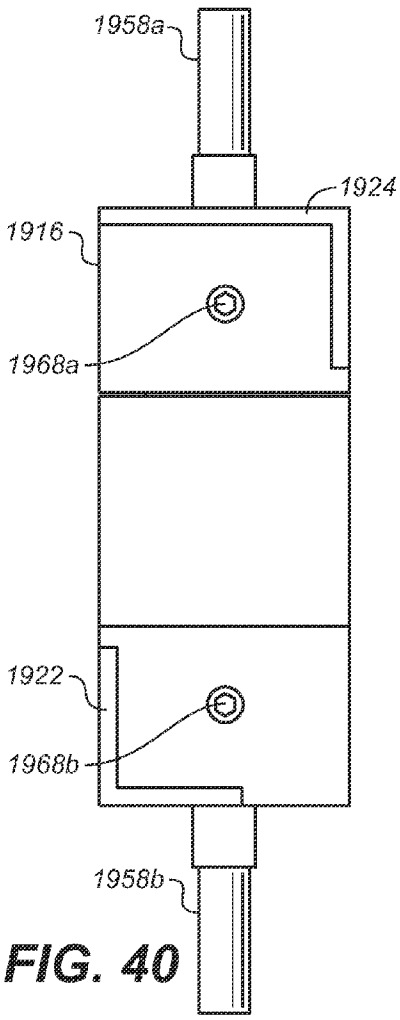
FIG. 40 is a front end view in elevation showing the mounting wings in the configuration shown in FIG. 37A taken along section line 40-40 of FIG. 39.
Figure 39:
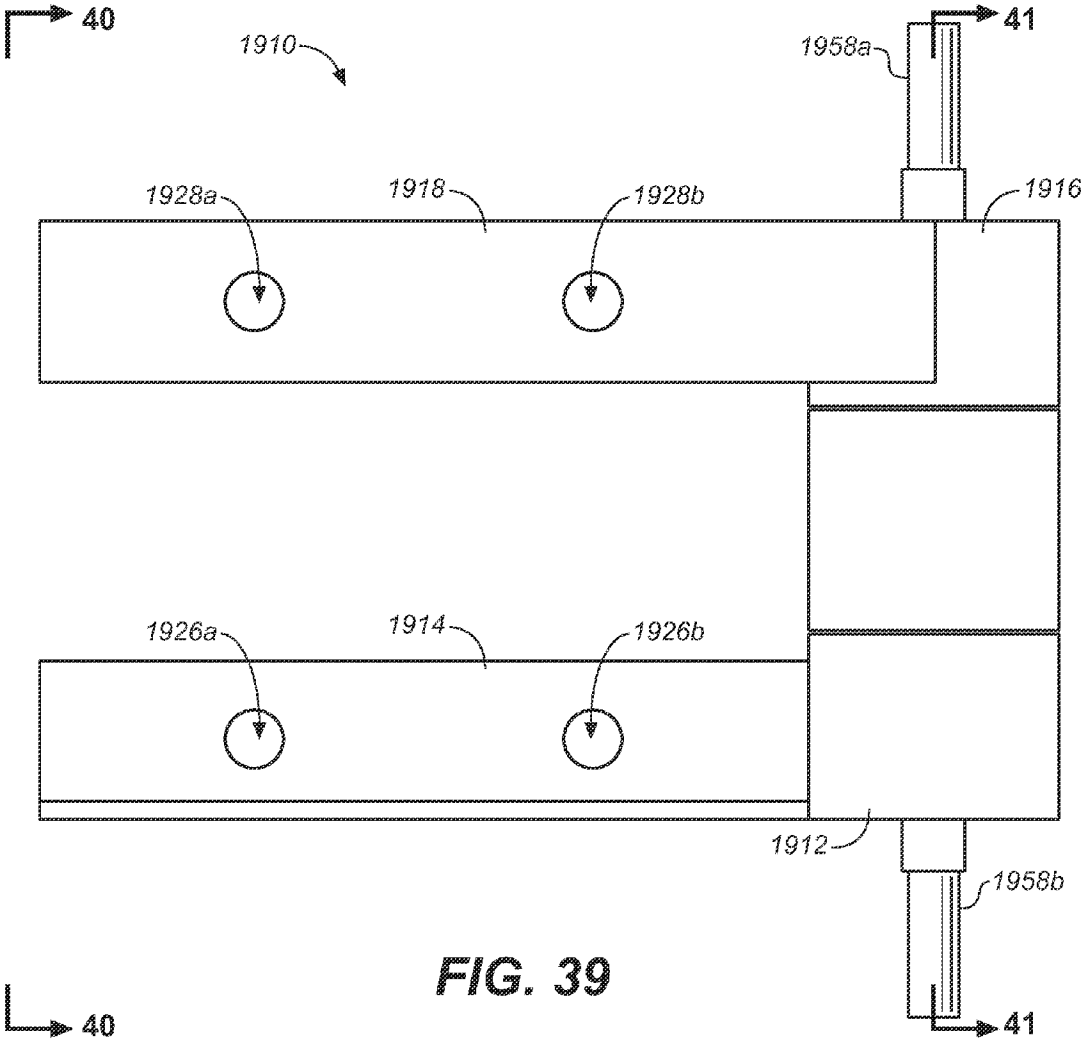
FIG. 39 is a side view in elevation of the assembly of FIG. 37A.
Figures 41A, 41B, 41C:
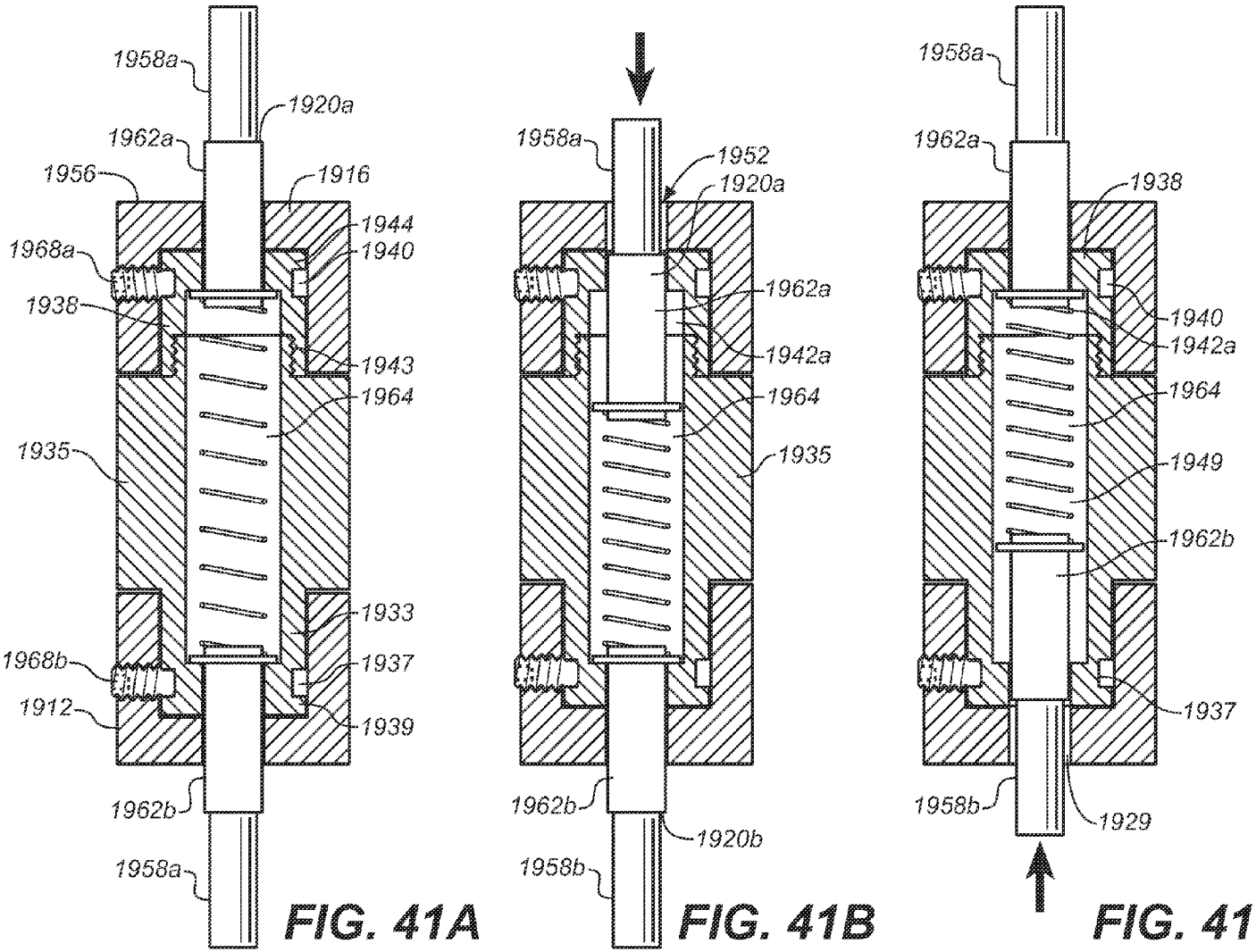
FIG. 41A is a cross-section side view in elevation taken along section line 41-41 of FIG. 39, showing details of the barrel elements and the hinge pin of a first preferred embodiment of the inventive locking hinge, this view showing both upper and lower barrels and wings of the locking hinge in a locked position.
FIG. 41B is a cross-section side view in elevation, also taken along section line 41-41 of FIG. 39, showing the upper barrel and wing of the locking hinge in an unlocked position.
FIG. 41C is a cross-sectional side view in elevation, also taken along section line 41-41 of FIG. 39, showing the lower barrel and wing of locking hinge in the unlocked position.

Referring next to FIGS. 38, 41A and 41B, it will be seen that the first barrel member 1912 includes a base portion or body 1934, which terminates in an upper shelf 1936, and includes an upper cylindrical bore 1931 into which is inserted a lower male element 1933 extending downwardly from the medial barrel 1935, which is disposed between the first and second barrel members 1912. The lower male element 1933 of the medial barrel 1935 includes an annular channel 1936 proximate its lower end 1939. The lower male element 1933 further includes a multi-sided center bore 1947 that extends inwardly into a larger through bore 1949 that continues through a threaded male neck 1943. The medial barrel 1935 has a lower rim 1941 that generally approximates the upper shelf 1936 of the first barrel member 1912. The medial barrel 1935 threaded male neck 1943 extends upwardly from the upper rim 1945 of the medial barrel, and onto the threaded male neck is screwed a cylindrical male portion 1938, which also includes an annular channel 1940. A multi-sided center bore 1942 extends downwardly from the top 1944 of the male portion 1938 until it opens into a bore 1942*a* that generally matches the upper center bore 1949 of the medial barrel, such that when male element 1938 is screwed onto medial barrel 1935, the bores 1949 and 1942*a* are contiguous and continuous. As in the embodiment shown in FIGS. 25-36, the multi-sided bore 1942 extending through the top 1944 of male element 1938 is polygonal and may have any of a number of sides so as to have a cross-sectional shape that is triangular, square, pentagonal, or the like. In the alternative, the bore may also be splined, the selection of shape being determined by the range of motion and number of possible locking positions desired.

The second barrel member 1916 includes a cylindrical female recess or bore 1948 into which the cylindrically shaped male portion 1938 is inserted. It further includes a multi-sided center bore 1952 through its top, shaped and sized substantially identically to that of the multi-side center bore 1942 disposed in the cylindrical male portion 1938. The lower edge 1954 of the second barrel member is adapted for seating on the top shelf 1945 of the medial barrel member, while the outer end (or upper side) 1956 is preferably, though not necessarily, planar.

As will be appreciated, the recesses 1948 and 1931 in the upper and lower barrel members are substantially identical in their cylindrical dimensions, and the cylindrical lower male portion 1933 of the medial barrel is essentially dimensionally identical to the cylindrical male element 1938 that attaches to the medial barrel member 1935, such that the combination renders the medial barrel member essentially symmetrical about its upper and lower halves. In effect, it could be inverted and the lower male portion could insert into the recess 1948 of the upper barrel member 1916 and the cylindrical male element could insert into the recess 1931 in the lower barrel member 1912 without altering the operation or organizational features of the hinge.

It will be further appreciated that the precise means of affixing the cylindrical male element 1938 to the medial barrel member is a matter of design choice, insofar as a the cylindrical male threaded male neck is easily formed by machining the parts, but the attachment could be accomplished through welding, industrial adhesives, and so on. Further, the cylindrical male element could be provided with male threads that threadably screw into female threaded recess in the medial barrel member. Thus, the salient feature characterizing the combination medial barrel and cylindrical male element is the external and internal symmetry of the element between its upper and lower halves. Once the cylindrical male element is attached to the medial barrel, there is thus provided a medial barrel having upper 1938 and lower 1933 cylindrical male portions, each with an annular exterior groove 1937, 1940, and each with multi-sided center bore 1942, 1929, contiguous with a larger diameter center bore, 1942, 1942*a*, which is, in turn, contiguous with a larger diameter center bore 1949 through the body 1935 of the medial barrel member.

In this preferred embodiment the hinge pin 1920 is split into two distinct pieces, an upper pin 1920*a* and a lower pin 1920*b*. Each pin includes an outer cylindrical portion 1958*a*, 1958*b*, respectively, and an inner multi-sided portion 1962*a*, 1962*b*, respectively. The inner multi-sided portions 1962*a*, 1962*b*, have a cross-sectional shape identical to that of the multi-sided center bores 1929 and 1952 of the first and second barrel portions, respectively, as well as the multi-sided center bores 1942, 1929 of the cylindrical male element 1938 and the male portion of the medial barrel, respectively. The multi-sided portions of the lower and upper hinge pin are each are sized slightly smaller than the various multi-sided center bores for a fit within the center bores with generally tight clearances. The cylindrical portions have a smaller diameter than any open dimension of the multi-sided center bores, such that the cylindrical portions can rotate freely axially within any multi-sided center bore. A helical compression spring 1964 is provided for installation between the upper and lower pins and around the respective multi-sided portions. The pin is retained by and between rings 1963*a*, 1963*b*, integral or welded to the pins and disposed around each multi-sided portion.

In assembly, the medial barrel 1938 is dropped into the cylindrical bore 1931 of the first barrel portion 1912, and screw 1968*b* is screwed into threaded hole 1966*b* sufficiently to insert into annular groove 1937 so as to retain the medial barrel 1935 in the first barrel 1912. Lower pin 1920*b* is then dropped through the aligned center bores 1949, 1929, of the medial barrel and first barrel member, respectively, and helical compression spring 1964 is placed over the lower pin. The cylindrical portion 1958*a* of upper pin 1920*a* is then inserted through the cylindrical bore 1942*a* and multi-sided bore 1942 of the cylindrical male portion 1938, and the cylindrical male portion 1938 is then screwed onto the threaded male neck 1943 of the medial barrel 1935. This captures and slightly compresses the helical compression spring 1964 within the contiguous center bores 1949, 1942*a*, respectively, of the medial barrel 1935 and the cylindrical male element 1938. Male element 1938 is then inserted into the female recess or center bore 1948 in the underside of the second barrel member 1916, and screw 1968*a* is screwed into threaded hole 1966*a* sufficiently to insert into groove 1940 in male cylindrical element 1938, such that the cylindrical male element is retained in the second barrel member. The screws 1968*a* and 1968*b* are tightened only enough to keep the barrel members coupled to the medial barrel member, but not so tight as to prevent free rotation of either first or second barrel members in relation to the medial barrel and to one other.

When assembled each cylindrical portion of the upper and lower pins extends through its respective barrel member. Spring 1964 will urge both pins outwardly. If the pins are full extended and the multi-sided center bores 1949 and 1929 of the medial portion and lower barrel 1912 are aligned, and the multi-sided center bores 1942, 1952 of the cylindrical male element 1938 and upper barrel member 1916 are also aligned, neither barrel or wing may be rotated relative to the medial barrel or in relation to one another. Each pin is full extended in a locked position, as seen in FIG. 41A. The barrel members and thus prevented from rotation in relation to one another.

When it is desired to rotate the barrel and wing elements in relation to one another (and thus any structure that may be affixed to the respective wing elements), either or both upper and/or lower hinge pin 1920*a*, 1920*b*, is simply pushed inwardly, as shown in FIGS. 41B and 41C. When the multi-sided center bore 1929, 1952 of the first and second barrel members 1912, 1916 are cleared by the respective multi-sided portion 1962*b*, 1962*a* of the respective lower and upper hinge pins 1920*b*, 1920*a*, the barrels may be moved in relation to the medial barrel member 1935. Any rotation of the barrel members in relation to one another when the hinge pin is in the unlocked position will bring the sides of the respective multi-sided center bores out of alignment and prevent the multi-sided medial portion 1962 of the hinge pin 1920 from returning into engagement with the multi-sided center bore 1950 of the second barrel member 1916. Throughout a predetermined range of motion, the freed (unlocked) barrel member and wing will rotate freely until the sides of the multi-sided center bores are again in alignment, at which point if the hinge pin is not still pushed into the unlocked position, the compression spring will again urge the depressed hinge pin outwardly into so as to bring the multi-sided portion of the pin into engagement with the multi-sided center bore in the barrel member, and thus into the locked position, which would be the next in order locking position. Proceeding to rotate the pivoting wing of the locking hinge beyond this point will require that the hinge pin again be pushed so as to disengage the multi-sided portion of the hinge pin from the multi-sided center bore of the involved barrel member.

It will be appreciated that the present invention in all of the above-described embodiments has nearly unlimited applications. It may be used on doors and gates in a well known manner, and it may be used on a tailgate extension, as described above. However, it is also well suited for use in providing selectively deployable workbenches, tables, shelves, or even beds, each mounted on a wall and having an undeployed configuration in which the surface (e.g., a panel) is laid substantially onto the plane of a vertical wall, and a deployed configuration, in which the panel is deployed 90 degrees in relation to the wall, such that it provides a surface on which to work, place items, sleep, and so forth. With barrels and wings made sufficiently robust, the installation can be used to support considerable weight.

From the foregoing, it can be seen that in its most essential aspects, this final embodiment is yet again a locking hinge, but this embodiment departs from the earlier described embodiments insofar as it makes possible both a plurality of fully locked configurations and a plurality of unlocked configurations, each involving movement of both barrels of the lock. It includes first and second barrel members, each having an affixed wing, a cylindrical female recess, and a multi-sided center bore; a medial barrel member disposed between said first and second barrel members and including center bore, a first cylindrical male portion rotatably inserted into said cylindrical female recess of said first barrel member, and a second cylindrical male portion rotatably inserted into said cylindrical female recess of said second barrel member, each of said first and second cylindrical male portions having a multi-sided center bore, wherein all of said center bores and said center bore of said medial barrel member are in axial alignment; first and second hinge pins, each having a cylindrical outboard portion and a multi-sided inboard portion, wherein the cross-sectional shape of said multi-sided inboard portion matches the shape of said multi-sided center bores, such that said multi-side inboard portions slidably insert through said multi-sided center bores with tight clearances; and a compression spring disposed in said center bore of said medial barrel member and between said inboard portions of said first and second hinge pins so as to urge said first and second hinge pins apart; wherein when said locking hinge is in a fully locked configuration, said multi-sided portion of said first hinge pin engages both said multi-sided center bore of said first male portion and said first barrel member and said multi-sided portion of said second hinge pin engages both said multi-sided center bore of said second male portion and said multi-sided center bore of said second barrel member; and wherein when said locking hinge is in an unlocked configuration, at least one or both of said first and second hinge pins is depressed such that its respective multi-sided portion is disengaged from the multi-sided center bore of the barrel member through which it is slidably inserted.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A locking hinge having a plurality of fully locked configurations and a plurality of unlocked configurations, comprising:

first and second barrel members, each having a cylindrical female recess and a multi-sided center bore;

a medial barrel member disposed between said first and second barrel members and including a center bore, a first cylindrical male portion rotatably inserted into said cylindrical female recess of said first barrel member, and a second cylindrical male portion rotatably inserted into said cylindrical female recess of said second barrel member, each of said first and second cylindrical male portions having a multi-sided center bore, wherein said multi-sided center bores of said first and second barrel members, said multi-sided center bores of said first and second cylindrical male portions, and said center bore of said medial barrel member are in axial alignment;

first and second hinge pins, each having a cylindrical outboard portion and a multi-sided inboard portion, wherein the cross-sectional shape of said multi-sided inboard portion matches the shape of said multi-sided center bores, such that said multi-sided inboard portions slidably insert through said multi-sided center bores with tight clearances; and a compression spring disposed in said center bore of said medial barrel member and between said inboard portions of said first and second hinge pins so as to urge said first and second hinge pins apart;

wherein when said locking hinge is in a fully locked configuration, said multi-sided portion of said first hinge pin engages both said multi-sided center bore of said first male portion and said multi-sided center bore of said first barrel member and said multi-sided portion of said second hinge pin engages both said multi-sided center bore of said second male portion and said multi-sided center bore of said second barrel member for preventing relative rotation; and wherein when said locking hinge is in an unlocked configuration, at least one of said first and second hinge pins is depressed such that at least one of the multi-sided portions of the first and second hinge pins is disengaged from at least one of the multi-sided center bore of the corresponding first and second barrel member through which it is slidably inserted.

2. The locking hinge of claim 1, further including a first and second retention member for retaining said first and second male portions in the respective female recess of the first and second barrel members.

* * * * *